US006102003A

United States Patent [19]

Hyodo et al.

[11] Patent Number: 6,102,003

[45] Date of Patent: Aug. 15, 2000

[54] APPARATUS FOR DETECTING CONCENTRATION OF FUEL VAPOR IN LEAN-BURN INTERNAL COMBUSTION ENGINE, AND APPLIED APPARATUS THEREOF

[75] Inventors: Yoshihiko Hyodo, Gotenba; Naoya Takagi; Toshimi Murai, both of Susono, all of Japan

[73] Assignee: Toyota Jidosha Kabushiki Kaisha, Toyota, Japan

[21] Appl. No.: 09/273,515

[22] Filed: Mar. 22, 1999

[30] Foreign Application Priority Data

Mar. 30, 1998 [JP] Japan ..... 10-084776

[51] Int. Cl.[7] ..... F02M 7/00

[52] U.S. Cl. ..... 123/436; 123/520; 123/698

[58] Field of Search ..... 123/435, 436, 123/698, 520, 295

[56] References Cited

U.S. PATENT DOCUMENTS

| | | | |
|---|---|---|---|
| 5,245,975 | 9/1993 | Ito . | |
| 5,438,967 | 8/1995 | Ito . | |
| 5,613,481 | 3/1997 | Kitagawa et al. . | |
| 5,694,904 | 12/1997 | Osanni | 123/520 |
| 5,754,971 | 5/1998 | Matsumoto et al. | 123/698 |
| 5,765,372 | 6/1998 | Mitobe et al. . | |
| 5,950,603 | 9/1999 | Cook et al. | 123/520 |

FOREIGN PATENT DOCUMENTS

| | | |
|---|---|---|
| 44 02 588 A1 | 4/1994 | Germany . |
| 195 38 786 A1 | 4/1997 | Germany . |
| 4-194354 | 7/1992 | Japan . |
| 4-295150 | 10/1992 | Japan . |
| 5-71430 | 3/1993 | Japan . |
| 5-223017 | 8/1993 | Japan . |
| 6-137190 | 5/1994 | Japan . |
| 6-147033 | 5/1994 | Japan . |
| 6-200794 | 7/1994 | Japan . |
| 8-177572 | 7/1996 | Japan . |

*Primary Examiner*—Erick Solis
*Attorney, Agent, or Firm*—Oliff & Berridge, PLC

[57] ABSTRACT

A fuel vapor concentration detecting apparatus in a lean-burn internal combustion engine detects a fuel vapor concentration and executes purge control. The apparatus includes an output fluctuation detecting module for detecting, on such an occasion that the fuel vapor is purged into an intake system of the internal combustion engine, an output fluctuation just when the fuel vapor is purged, and a concentration detecting module for calculating the fuel vapor concentration in accordance with a magnitude of the output fluctuation detected by the output fluctuation detecting module. The fuel vapor concentration in the lean-burn internal combustion engine is thus detected. A purge quantity or a state of the fuel injection is changed corresponding to the detected concentration of the fuel vapor.

19 Claims, 26 Drawing Sheets

APPARATUS FOR DETECTING CONCENTRATION OF FUEL VAPOR IN LEAN-BURN INTERNAL COMBUSTION ENGINE, AND APPLIED APPARATUS THEREOF

BACKGROUND OF THE INVENTION

1. Field of the Invention

The present invention relates to a fuel vapor supply control apparatus in a lean-burn internal combustion engine, which supplies an intake system with a fuel vapor produced in, e.g., a fuel tank etc in accordance with an operating state of the lean-burn internal combustion engine, and particularly to an apparatus for detecting a concentration of the fuel vapor.

2. Related Background Art

In an engine which has hitherto generally been used, the fuel is injected out of a fuel injection valve to an intake port, and a combustion chamber is previously supplied with a uniform air-fuel mixture of the furl and the air. In the thus constructed engine, an intake passageway is opened and closed by a throttle valve interlocking with an operation of an accelerator.

A quantity of the intake air supplied to the combustion chamber of the engine (which is resultantly a quantity of a uniformly mixed gas of the fuel and the air) is controlled by opening and closing the throttle valve, thereby controlling an output of the engine.

According to the technology based on the so-called uniform combustion described above, a large intake negative pressure is produced with a throttle operation of the throttle valve, and a pumping loss becomes large, resulting in a decline of efficiency. By contrast, a technology known as a so-called stratified charge combustion, wherein the throttle valve is throttled small, the fuel is supplied directly to the combustion chamber, a combustible air-fuel mixture is thereby made to exist in the vicinity of a spark plug, and an igniting property is enhanced by increasing an air/fuel ratio of the portion concerned. According to this technology, when in a low-load state of the engine, the fuel injected is supplied in dispersion around the spark plug, and the stratified charge combustion is executed with the throttle valve substantially fully opened. The pumping loss is thus reduced, and a fuel consumption is enhanced.

Th internal combustion engine capable of performing the above-described stratified charge combustion sequentially assumes, for example, when changed from the low-load to a high-load, combustion states such as the stratified charge combustion, a weak stratified charge combustion, a uniform lean-burn and a uniform combustion.

The stratified charge combustion is, as explained before, that the air/fuel mixture exhibiting a low air/fuel ratio is made to exist in the vicinity of the spark plug, and is stratified between this mixture and a gas at another portion.

The weak stratified charge combustion has a smaller degree of its being stratified than the stratified charge combustion.

The uniform lean-burn has a uniformity of the fuel and the air but is small in terms of a ratio of the fuel.

The uniform combustion has a uniform mixture of the fuel and the air and a high ratio of the fuel.

Further, there might be a case where a swirl is formed in the air/fuel mixture of the injected fuel when the above-described stratified charge combustion is conducted, and when the lean-burn is effected. That is, an intake port is provided with a swirl control valve (SCV), and an aperture of this valve SCV is controlled, thereby controlling an intensity of the swirl. As a result, the combustibility is enhanced with a small amount of the fuel supplied.

Incidentally, there is known an apparatus for controlling a supply of a fuel vapor in a lean-burn internal combustion engine (Japanese Patent Application Laid-Open Publication No.4-194354) constructed such that the fuel vapor (vapor) from the fuel tank etc is temporarily accumulated in a canister, and the fuel vapor accumulated is supplied to an intake system in accordance with an operating state of the internal combustion engine.

According to this technology, a purge control valve is provided within a fuel vapor oriented purge passageway through which the canister for adsorbing the fuel vapor is connected to an intake passageway. Then, the purge control valve is controlled so as to obtain a proper fuel purge quantity (a quantity of the fuel vapor introduced into the intake passageway, which is hereinafter simply referred to as a purge quantity) (e.g., so as to supply the fuel vapor if a load of the engine is large) in accordance with the operating state of the engine.

In a lean-burn region, however, the air/fuel ratio can not be detected at a high accuracy, and hence a real situation is that there is no index for controlling the fuel purge quantity.

To be more specifically, according to the prior art, the air/fuel ratio sensor such as an oxygen sensor is disposed in the exhaust passageway, and an actual air/fuel ratio is detected based on an output signal of this sensor. Then, the fuel injection quantity etc is feedback-controlled so that the air/fuel ratio of the air/fuel mixture becomes a target air/fuel ratio specially calculated. At this time, even when the air/fuel ratio becomes rich with an execution of purging the fuel vapor, the feedback control is performed so that the air-fuel mixture comes to have the target air/fuel ratio. The oxygen sensor described above, however, makes such a detection that the target air/fuel ratio (A/F) is in the vicinity of, e.g., a stoichimetric air/fuel ratio (A/F=14.5). In the case of the lean-burn where the air/fuel ratio is larger than this stoichimetric air/fuel ratio, it is impossible to highly accurately detect a change in the air/fuel ratio due to the purging. Besides, it is impossible to precisely calculate an index (e.g., a concentration of the fuel vapor) for controlling the purge quantity of the fuel vapor which has hitherto been calculated from the output of the air/fuel ratio sensor in the prior art.

Therefore, in the above-described lean-burn region, an accuracy of calculating a purge quantity declines if the air/fuel ratio is not detected, and if the detected air/ratio does not exhibit a high accuracy in the case of controlling a fuel vapor supply quantity. Then, if the fuel vapor supply controlling apparatus is controlled based on the purge quantity determined from the negative pressure, there might be a possibility in which an accidental fire and a surge occur when the vapor is rich.

SUMMARY OF THE INVENTION

It is a primary object of the present invention, which was devised under such circumstances, to provide an apparatus for detecting a concentration of fuel vapor in a lean-burn internal combustion engine and an applied apparatus thereof, which are capable of detecting a concentration of a fuel vapor and properly controlling an operation of the internal combustion engine on the basis of the detected concentration.

To accomplish the object given above, according to a first aspect of the invention, in a lean-burn internal combustion engine comprising a purge passageway for purging, into an intake system of the internal combustion engine, a fuel vapor generated from fuel storing module for storing the fuel of the internal combustion engine, and a purge control module for controlling a quantity of the fuel vapor introduced into the intake system from the purge passageway in accordance with an operating state of the internal combustion engine, an apparatus for detecting a concentration of a fuel vapor in a lean-burn internal combustion engine, comprises an output fluctuation detecting module for detecting an output fluctuation when the fuel vapor is purged, and a concentration detecting module for calculating a concentration of the fuel vapor in accordance with a magnitude of the output fluctuation detected by the output fluctuation detecting module.

Herein, the concentration detecting module may be constructed such that a storage device is stored with, in the form of a map, a distribution of the concentrations corresponding to magnitudes of the output fluctuations, and the concentration detecting module calculates the concentration from the detected output fluctuation with reference to the map.

Normally, the output fluctuation becomes larger as a fuel injection quantity get smaller. Then, a relationship between the fuel injection quantity and the output fluctuation is drawn out through an experiment etc, and can be developed as a map on the basis of the empirical data.

The concentration detecting module in the apparatus according to the present invention is capable of detecting the concentration throughout an execution of the purging but may also detect the concentration when a certain fixed condition is established.

The fixed condition implies when a start-of-purge permission condition is established, for example, immediately after the start-of-purge permission condition has been established, or after a predetermined time has elapsed since the start-of-purge permission condition was established. Another fixed condition implies a case where an operating state such as a car speed and an engine speed falls within a certain fixed condition, or a case where an engine state such as a water temperature of the engine and a combustion state thereof comes to a certain fixed state, or when the ambient factors such as an atomospheric pressure and an intake air temperature meet predetermined conditions.

Further, a frequence of the detection may also be varied taking an operation time etc into consideration.

The purging may be interrupted, or the purge quantity may be controlled large or small by utilizing the concentration detected by the apparatus of the present invention.

Moreover, a combustion method and fuel injection states including a fuel injection quantity, a fuel injection timing, an intake air quantity and a number of fuel injections, may be changed corresponding to the detected concentration.

Further, in the case of being provided with an exhaust gas recirculation (EGR) device, a detection accuracy may be enhanced by interrupting an operation of the EGR device when detecting the concentration.

According to a second aspect of the present invention, an apparatus for controlling a supply of a fuel vapor in a lean-burn internal combustion engine, as an applied apparatus the above apparatus, comprises the purge passageway, the purge control module, the output fluctuation detecting module, the concentration detecting module, and in addition a flow rate changing module for changing a purge quantity on the basis of the fuel vapor concentration calculated by the concentration detecting module.

The fuel vapor supply controlling apparatus may further comprises an injection state changing module for changing a state of the fuel injection in accordance with the fuel vapor concentration. Note that the fuel injection quantity, the injection timing and an injecting direction may be each exemplified as the fuel injection state.

According to the present invention, the following constructions may also be added to the constructions described above.

The concentration detecting module detects the fuel vapor concentration in an operating state where the combustion in the internal combustion engine is stabilized.

The concentration detecting module detects the concentration from the output fluctuation when the fuel vapor is purged during a lean-burn operation.

When detecting an operating condition under which the concentration of the fuel vapor to be purged changes on the occasion of the detection of the fuel vapor concentration by the concentration detecting module, a concentration detection period is changed.

The concentration detecting module executes and stops the purge by the purge control module in accordance with a magnitude of the detected concentration.

The state of the fuel injection is a fuel injection timing, and the injection timing is changed corresponding to the detected concentration of the fuel vapor.

The lean-burn internal combustion engine includes exhaust gas recirculating module for recirculating the exhaust gas to the combustion chamber, and stopping the recirculation of the exhaust gas when the concentration detecting module detects the concentration.

As described so far, the apparatus according to the present invention is capable of properly detecting the fuel vapor concentration even in the lean-burn internal combustion engine, and, as a result, correcting the purge quantity and the state of the fuel injection in accordance with the fuel vapor concentration, whereby the proper combustion can be attained.

It should be noted that a general vehicle includes a canister for accumulating the fuel vapor produced from a fuel storing unit for storing the fuel of the internal combustion engine. Such being the case, according to the present invention, the purge passageway may be connected so that the canister communicates with the intake system of the internal combustion engine.

The respective features described above may be combined to the greatest possible degree and thus carried out.

These together with other objects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Other objects and advantages of the present invention will become apparent during the following discussion in conjunction with the accompanying drawings, in which.

DESCRIPTION OF THE PREFERRED EMBODIMENTS

Embodiments of the present invention will hereinafter be described in details with reference to the accompanying drawings.

Figure 1:
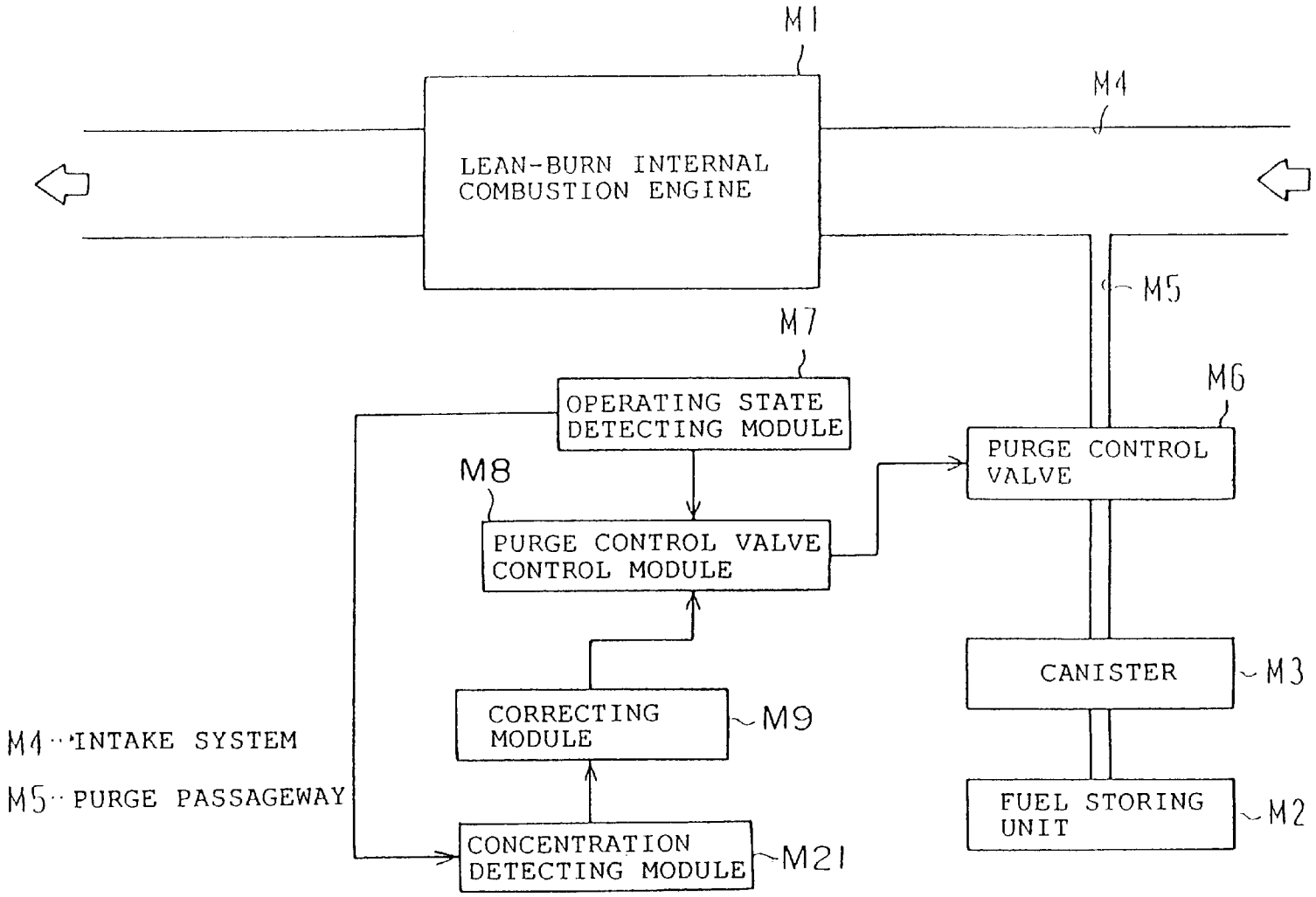
FIG. 1 is a conceptual diagram showing a basic construction in embodiments of the present invention.

FIG. 1 is a view showing an outline of an apparatus according to the present invention. Referring to FIG. 1, the symbol M designates a lean-burn internal combustion engine, and an unillustrated vehicle body is provided with a fuel storing unit M2 for storing a fuel for driving the lean-burn internal combustion engine M1. A canister M3 for accumulating a fuel vapor generated from the fuel storing unit M2, is connected to this fuel storing unit M2.

Provided further is a purge passageway M4 through which the canister M3 communicates with an intake system M4. A purge control valve M6 controls a fuel vapor quantity of the fuel vapor introduced into the intake system M4. This purge control valve M6 is provided midways of the purge passageway M5, as a purge control unit for controlling the quantity of the fuel vapor introduced into the intake system from the purge passageway M5 in accordance with an operating state of the internal combustion engine. Further, an operating state detecting unit M7 for detecting an operating state of the internal combustion engine is provided also as a purge control unit. Provided also is a purge control valve control module M8 for controlling an aperture of the purge control valve in accordance with the operating state detected by the operating state detecting unit M7.

Note that the operating state detecting unit detects also a fluctuation in an output, and corresponds to an output fluctuation detecting unit according to the present invention. Moreover, there is provided a concentration detecting unit M21 for calculating a concentration of the fuel vapor in accordance with a magnitude of the fluctuation in the output which is detected by the operating state detecting unit (the output fluctuation detecting unit).

Moreover, a correcting module M9 for correcting the quantity of the fuel vapor is connected to the purge control valve control module M8. The purge control valve control module M8 correction-controls the purge control valve M6 on the basis of a corrected value of the fuel vapor quantity corrected by the correcting module M9.

Herein, the correcting module M9 corrects a purge quantity, i.e., an aperture of the purge control valve or a state of the fuel injection in accordance with the fuel vapor concentration detected by the concentration detecting unit M21. Accordingly, the correcting module implies a concept embracing a flow-rate changing module and a state-of-injection changing module for changing the state of the fuel injection according to the present invention.

Figure 2:
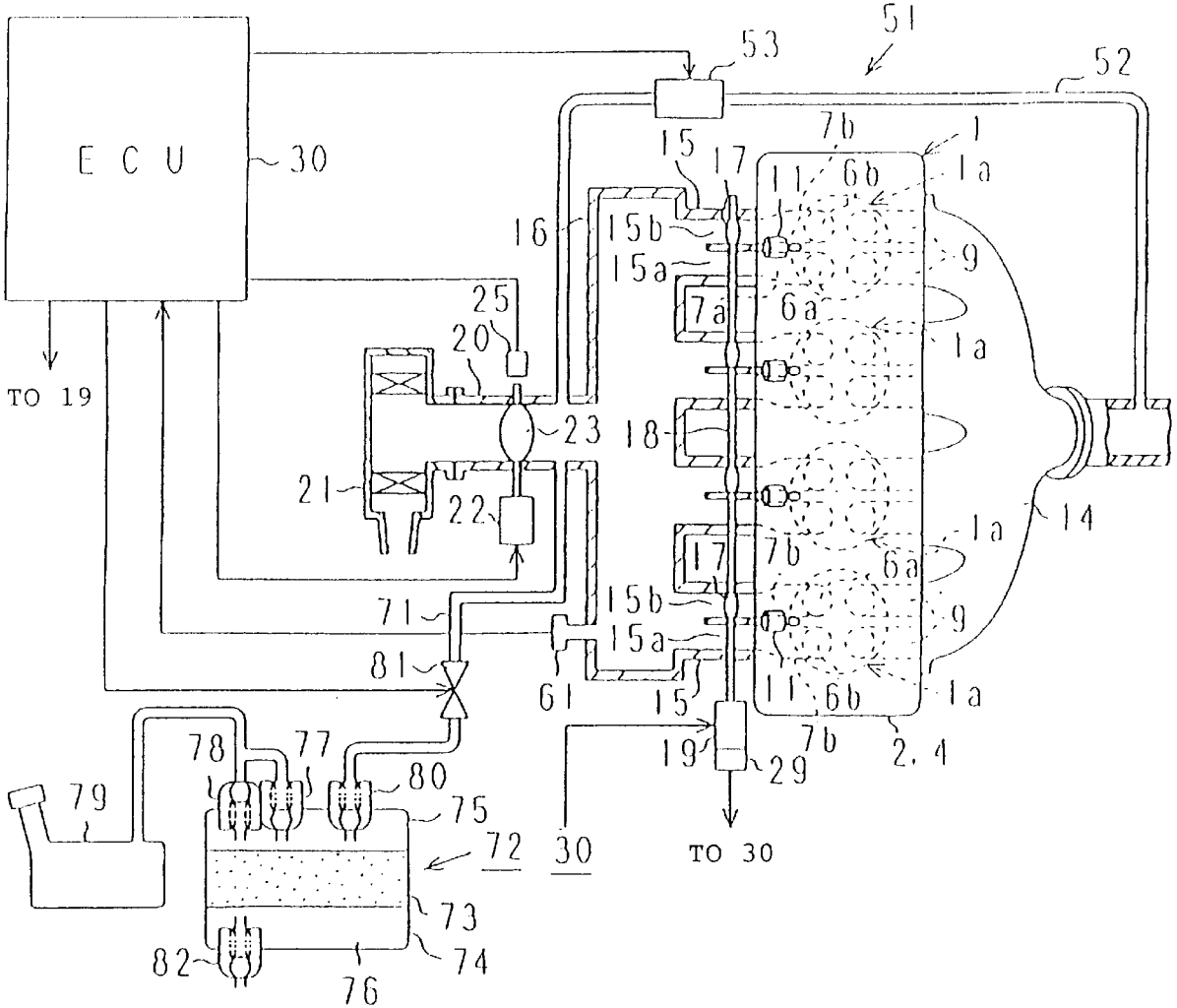
FIG. 2 is a diagram schematically showing a construction of a fuel vapor supply controlling apparatus in the embodiment of the present invention.
Figure 3:
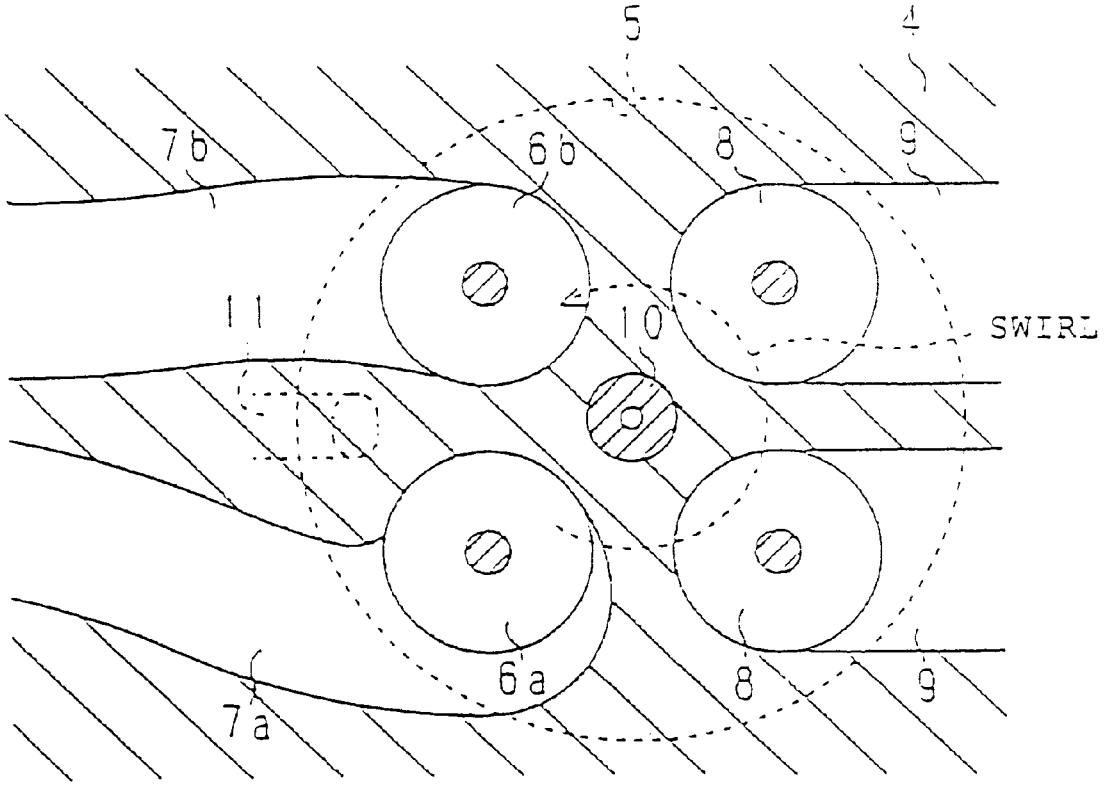
FIG. 3 is an enlarged sectional view showing a cylinder of the engine.

FIG. 2 is a diagram schematically showing a construction of a fuel vapor supply controlling apparatus in a cylinder injection type engine mounted in a vehicle. An engine 1 classified as an internal combustion engine includes, e.g., four cylinders 1*a*. FIG. 3 illustrates a structure of a combustion chamber of each cylinder la. As shown in FIGS. 2 and 3, the engine 1 incorporates a piston in a cylinder block 2, and this piston reciprocates within the cylinder block 2. A cylinder head 4 is provided in an upper portion of the cylinder block 2, and a combustion chamber 5 is formed between the piston and the cylinder head 4.

Further, in this embodiment, as illustrated in FIG. 3, four valve are disposed for one cylinder la. More specifically, first and second intake valves are provided in connection with first and second intake ports 7*a*, 7*b*, and a pair of exhaust valves 8, 8 are provided in connection with a pair of exhaust ports 9, 9.

As illustrated in FIG. 3, the first intake port 7*a* is classified as a helical type intake port, and the second intake port 7*b* classified as a straight port extending substantially straight. Further, a spark plug 10 is disposed at a central part of an inner wall surface of the cylinder head 4. Moreover, a fuel injection valve 11 serving as a fuel supply unit is disposed at a portion peripheral to the inner wall surface in the vicinities of the first and second intake valves 6*a*, 6*b*. That is, the fuel is injected out of the fuel injection valve 11 directly into the cylinder 1*a* in this embodiment.

As shown in FIG. 2, the first and second intake ports 7*a*, 7*b* of each cylinder la, are connected to a surge tank 16 via first and second intake passageways 15*a*, 15*b* formed in each intake manifold 15. Swirl control valves (SCV) 17 are disposed in the respective second intake passageways 15*b*. These swirl control valves SCV 17 are connected to a step motor 19 via a common shaft 18. This step motor 19 is controlled based on an output signal transmitted from an electronic control unit (hereinafter abbreviated to ECU) which will be described later on.

The surge tank 16 is connected via an intake duct 20 to an air cleaner 21, and a throttle valve 23 closed and opened by another step motor 22, is disposed in the intake duct 20. Namely, the throttle valve 23 in this embodiment is of a so-called electronic control type and is basically driven by the step motor 22 on the basis of an output signal corresponding to a pedaling quantity of an accelerator pedal of the vehicle, this controlling the opening/closing of the throttle valve 23. Then, a quantity of intake air introduced into the combustion chamber 5 through the intake duct 20, is controlled by opening and closing the throttle valve 20. In this embodiment, the intake duct 20, the surge tank 16 and the first and second intake passageways 15*a*, 15*b*, constitute an intake passageway serving as an intake system. Further, a throttle sensor 25 for detecting an aperture of the throttle valve 23 (which is referred to as a throttle aperture TA), is provided in the vicinity of the throttle valve 23.

In the cylinder injection type internal combustion engine in this embodiment, the throttle valve 23 is kept at an aperture substantially equal to a full-open state excluding when in an extremely low-load operation.

Note that an exhaust manifold 14 is connected to the exhaust port 9 of each cylinder, and an exhaust gas after being burned is discharged to an unillustrated exhaust duct through the exhaust manifold 14.

Moreover, in this embodiment, a known exhaust gas recirculation (EGR) device 51 is provided. This EGR device 51 includes an EGR passageway 52 serving as an exhaust gas recirculation passageway, and an EGR valve 53 serving as an exhaust gas recirculation valve provided midways of the EGR passageway 52. The EGR passageway 52 is provided in such a way that the intake duct 20 disposed downstream of the throttle valve 23 communicates via the EGR passageway 52 with the exhaust duct.

Further, the EGR valve 53 incorporates a valve seat, a valve member and a step motor (of which each is not shown), and these components constitute an EGR mechanism. The valve member is intermittently displaced with respect to the valve seat by the step motor, whereby an aperture of the EGR valve 53 changes. Then, with the EGR valve 53 opened, a part of the exhaust gas discharged to the exhaust duct flows to the EGR passageway 52. The exhaust gas ten flows to the exhaust duct 20 via the EGR valve 53. Namely, some of the exhaust gas is recirculated in an intake air/fuel mixture by the EGR device 51. At this time, the aperture of the EGR valve 53 is controlled, thereby controlling a quantity of the recirculation of the exhaust gas.

As shown in FIG. 2, the intake duct 20 is fitted with purge control device 72 for supplying the fuel vapor into the intake duct 20. This purge control device 72 includes a canister 74 having an activated carbon layer 73, and a fuel vapor chamber 75 and an air chamber 76 are formed on both sides of the activated carbon layer 73 within the canister 74. The fuel vapor chamber 75 is connected to a fuel tank 79 serving as a fuel storing unit via a couple of check valves 77, 78 disposed in a side-by-side relationship and each capable of permitting a flow thereof in an opposite direction.

Further, a connecting pipe 71 serving as a purge passageway is connected between the value fuel chamber 75 and the intake duct 20 disposed downstream of the throttle valve 23. A first electromagnetic valve 81 and a check valve 80 capable of permitting only a flow thereof in a direction into the intake duct 20 from the fuel vapor chamber 75, are connected to the connecting pipe 71. The electromagnetic valve 81 is classified as a control valve capable of performing the duty control with the aid of an ECU 30 which will be mentioned later on, and constitutes a purge control valve.

The duty control is intended to control an aperture corresponding to a duty ratio of an input pulse signal.

The air chamber 76 communicates with the atmospheric air via a check valve 82 capable of permitting only a flow toward the air chamber 76 from the atmospheric air.

Wen the supply of the fuel vapor into the intake duct 20 should be stopped, the electromagnetic valve 81 is closed under the control of the ECU 30 which will hereinafter be described later on. At this time, the fuel vapor produced within the fuel tank 79 flows via the check valve 78 into the fuel vapor chamber 75, and is subsequently adsorbed to the activated carbon in the activated carbon layer 73.

When a pressure in the fuel tank 79 lowers, the check valve 77 is opened. Accordingly, this check valve 77 prevents the fuel tank 79 from being deformed due to the decreases in the internal pressure of the fuel tank 79.

By contrast, when supplying the fuel vapor into the intake duct 20, the electromagnetic valve 81 is opened under the control of the ECU 30. Thereupon, an intake pipe negative pressure of the intake duct 20 is led to the canister 74, and the air flows from outside into the air chamber 76 via the check valve 82 and is supplied permeating the activated carbon layer 73. At this time, the activated carbon is desorbed of the fuel adsorbed thereto, whereby the air containing the fuel component (fuel vapor) flows into the fuel vapor chamber 75. Subsequently, this fuel vapor is supplied into the intake duct 20 through the check valve 80 and the electromagnetic valve 81.

Figure 4:
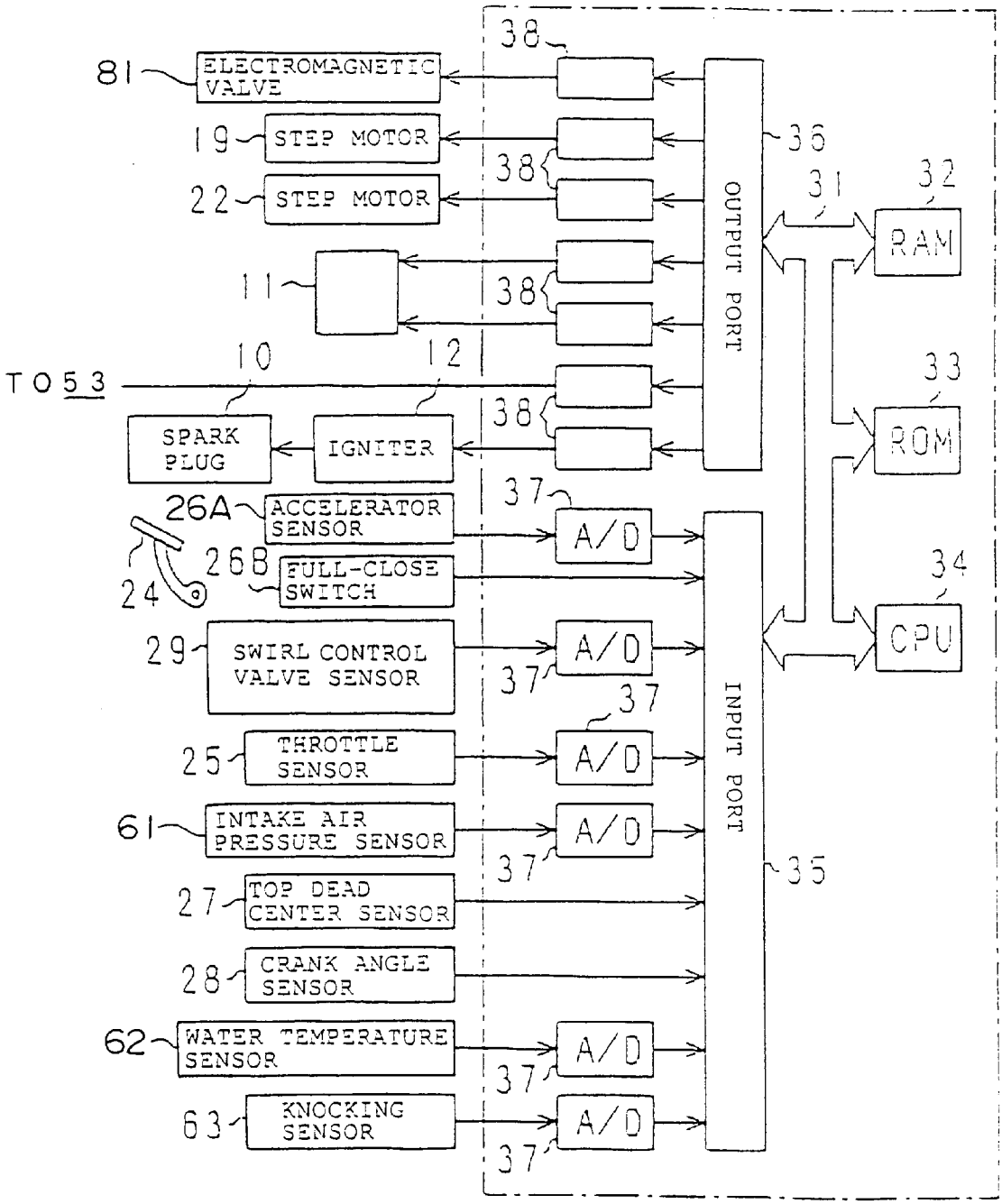
FIG. 4 is a block diagram schematically showing an electric circuit of an ECU.

Now, as shown in FIG. 4, the digital-computer-based ECU 30 described above includes a RAM (Random Access Memory) 32, a ROM (Read-Only Memory) 33, a CPU (Central Processing Unit) 34 constructed of a microprocessor, an input port 35 and an output port 36, which are connected to each other via a bidirectional bus 31. In this embodiment, the fuel supply quantity control module, the purge control valve control module and the correcting modules (the flow rate changing module, and the state-injection changing module) are actualized in terms of their structures by the ECU 30. These modules are each structured of a combination of hardware and software. The software is previously written to the ROM and loaded down to the CPU, whereby the respective modules are actualized.

An accelerator sensor 26A for generating an output voltage proportional to a pedaling quantity of the accelerator pedal 24, is connected to the accelerator pedal 24. An accelerator aperture ACCP is detected by the accelerator sensor 26A. An output voltage of the accelerator sensor 26A is inputted to the input port 35 via an A/D converter 37.

Similarly, the accelerator pedal 24 is provided with a full-closing switch 26B for detecting that the pedaling quantity of the accelerator pedal 24 is 0". To be specific, this full-closing switch 26B generates a signal of 1" as a full-closing signal XIDL if the pedaling quantity of the accelerator pedal 24 is 0" and generates, if not, a signal 0". Then, an output voltage of his ful-closing switch 26B is also inputted to the input port 35.

Further, a top dead center sensor 27 generates an output pulse when the piston of, e.g., the first cylinder la reaches an intake top dead center, and this output pulse is inputted to the input port 35. A crank angle sensor 28 generates an output pulse each time a crank shaft makes a CA-rotation through, e.g., 30 degree, and thus output pulse is inputted to the input port 35. The CPU 34 calculates (reads) an engine speed NE on the basis of the output pulse of the top dead center sensor 27 and the output pulse of the crank angle sensor 28.

Moreover, an angle of rotation of the shaft 18 is detected by a swirl control valve sensor 29, and an aperture of the swirl control valve SVC 17 is thereby detected. Then, an output of the swirl control valve sensor 29 is inputted to the input port 35 via the A/D converter 37.

At the same time, the throttle sensor 25 detects a throttle aperture TA. An output of this throttle sensor 25 is inputted to the input port 35 via the A/D converter 37.

In addition, in this embodiment, there is provided an intake air pressure sensor 61 for detecting a pressure (an intake air pressure PIM) in the surge tank 16. Provided further is a water temperature sensor 62 for detecting a temperature of the cooling water (a cooling water temperature THW) of the engine 1. Outputs of these two sensors 61, 62 are also inputted to the input port 35 via the A/D converter 37.

Moreover, the cylinder block 2 of the engine 1 is attached with a knock sensor 63 serving as a knock detecting unit for detecting knocking of the engine 1. This knock sensor 63 is a kind of vibration pick-up and has such a characteristic as to be tunned so that a detection capability thereof is maximized when, for example,. a number of vibrations generated by knocking is coincident with a natural frequency of the detecting element and thereby resonate. An output of this knock sensor 63 is also inputted to the input port 35 via the A/D converter 37.

Further, the ECU 30 has a gate signal generator which outputs an open/close signal to the input port 35 on the basis of a signal from the CPU 34. Namely, the detection signal from the knock sensor 63 is inputted to the input port 35 in response to an open gate signal from the CPU 34, and is cut off by a close gate signal therefrom. Hence, a fixed period is provided for detecting (judging) the knocking.

On the other hand, the output port 36 is connected via a corresponding driving circuit 38 to each fuel injection valve 11, each of the step motors 19, 22, an igniter 12, the EGR valve 53 (the step motor) and the electromagnetic valve 81. Then, the ECU 30 preferably controls the fuel injection valve 11, the step motors 19, 22, the igniter 19, the EGR valve 53 and the electromagnetic valve 81 in accordance with a control program stored in the ROM 33 on the basis of the signals the variety of sensors 25–29 and 61–63.

The above sensors 25–29 and 61–63 constitute an operating state detecting module.

Next, programs related to the variety of control operations in the above-constructed fuel vapor supply controlling apparatus of the engine in this embodiment, will be explained with reference to flowcharts.

The fuel vapor supply control may include a case of duty-controlling the aperture of the purge control valve, a case of incrementing and decrementing the basic fuel injection quantity with a fuel vapor quantity correction quantity, and a case of using both of these cases.

In this embodiment, these fuel vapor supply control operations are performed based on a concentration of the fuel vapor. To start with, however, the control examples where the aperture of the purge control valve is duty-controlled and where the basic fuel injection quantity is incremented and decremented with the fuel vapor quantity correction quantity, will be exemplified irrespective of the concentration of the fuel vapor.

Example of Correcting Fuel vapor Quantity under Duty Control

Figure 5:
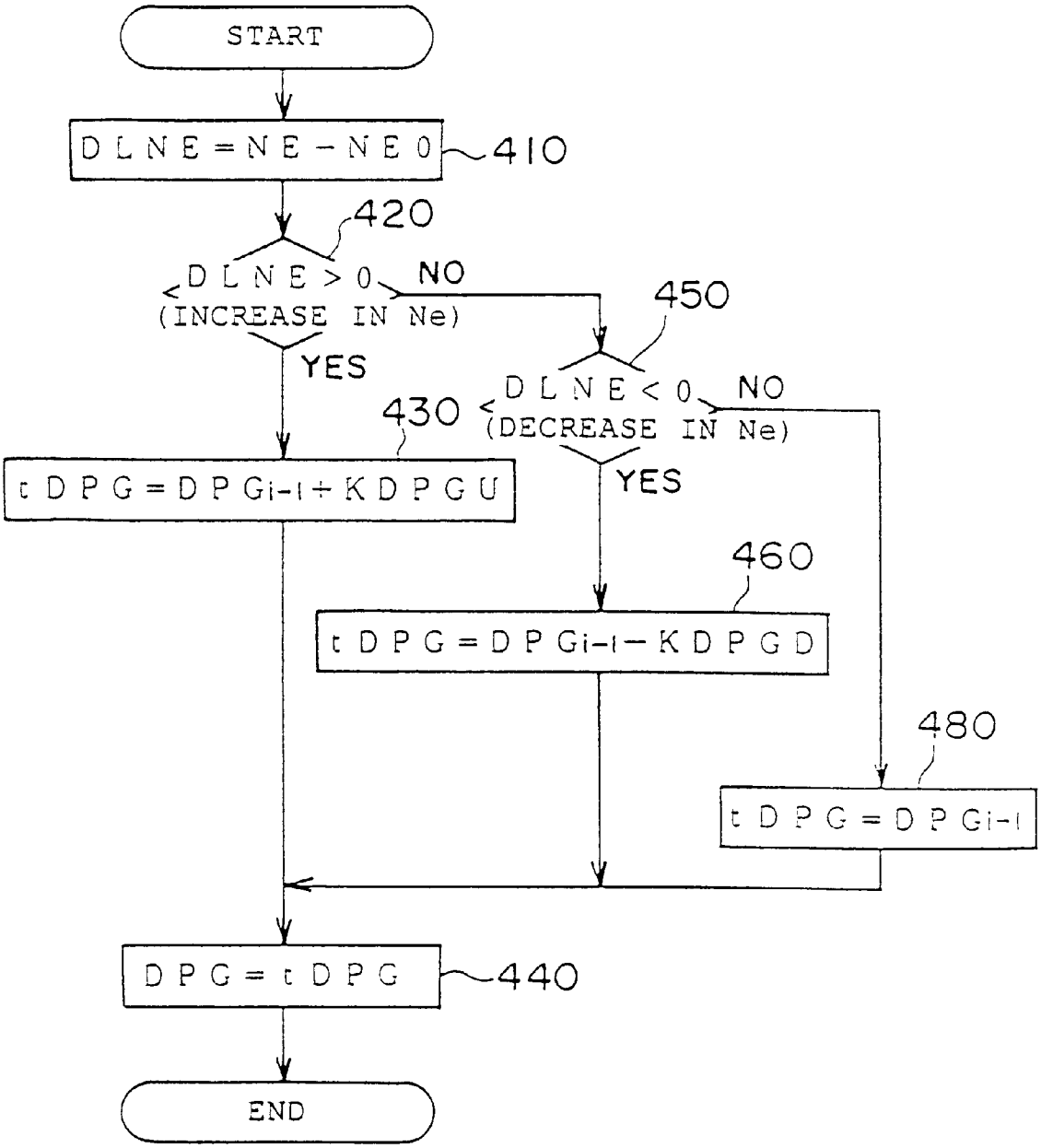
FIG. 5 is a flowchart showing a purge control routine under duty control.

FIG. 5 shows a purge control routine for executing purge control with reference to the engine speed. This routine is executed by the ECU 30 upon an interrupt at an interval of a predetermined time.

When the processing shifts to this purge control routine, the ECU 30 at first, in step 410, calculates a deviation DLNE between an engine speed NEO when the routine is executed last time and a present engine speed NE. Subsequently, it is judged in step 420 whether the deviation DLNE is larger than 0". When judging in step 420 that the deviation DLNE is larger than 0", the engine speed is on its increasing tendency, and therefore the processing proceeds to step 430. In step 430, a tentative request purge duty value tDPG is set to a value obtained by adding a purge duty updated quantity KDPGU to a value $DPG_{i-1}$ of the last time (which is a last request duty value obtained in the control routine of the last time). This purge duty updated quantity KDPGU is a value which is previously empirically obtained and stored in the ROM 33. Next, in step 440, the tentative request purge duty value tDPG calculated in step 430 is set as the last request duty value DPG, and this routine is ended.

When judging in step 420 that the deviation DLNE is not larger than 0", the processing proceeds to step 450, wherein it is judged whether or not the deviation DLNE is smaller than 0". When judging in step 450 that the deviation DLNE is smaller than 0", the processing proceeds to step 460. In step 460, the tentative request purge duty value tDPG is set to a value obtained by subtracting the purge duty updated quantity KDPGU from the value $DPG_{i-1}$ of the last time (which is the last request duty value obtained in the control routine of the last time). This purge duty updated quantity KDPGU is a value which is previously empirically obtained and stored in the ROM 33.

Next, in step 440, the tentative request purge duty value tDPG calculated in step 460 is set as the last request duty value DPG, and this routine is finished.

When judging in step 450 that the deviation DLNE is not smaller than 0", the deviation DLNE is 0", and it is assumed that there is no change in the engine speed. In this case, the processing diverts to step 480, and the tentative request purge duty value tDPG takes the same value as the value $DPG_{i-1}$ of the last time (which is the last request duty value obtained in the control routine of the last time).

Next, in step 440, the tentative request purge duty value tDPG calculated in step 480 is set as the last request duty value DPG, and this routine is finished.

Accordingly, the ECU 30 duty-controls the electromagnetic valve 81 based on the last request duty value DPG.

Note that a fuel vapor quantity correction quantity FPG) corresponding to the last request duty value is specially calculated in order to determined a quantity of the fuel injected from the injection valve, taking into consideration a fuel quantity corresponding to the fuel vapor introduced by the purge, and a last fuel injection quantity (QALLINJ) is calculated by subtracting the fuel vapor quantity correction quantity (FPG) from a previously calculated basic fuel injection quantity (QALL).

In the cylinder injection type internal combustion engine normally operated in a state where the throttle valve is substantially fully opened in many cases, the intake air quantity, i.e., the negative pressure is fixed, and therefore, when trying to control the purge quantity in accordance with at least one value among the air intake quantity, the load (air quantity/engine speed) and the intake pipe negative pressure, the combustion becomes unstable on the side of a low speed or an accidental fire might occur in the case of executing the same amount of purging both in the stratified charge combustion at a lower engine speed and in the uniform combustion at a higher engine speed. In this embodiment, the purge quantity is controlled in accordance with the engine speed by utilizing only the engine speed as a control parameter without depending upon the intake pipe negative pressure, and hence the stable combustion can be obtained.

Correction Example with Fuel vapor Quantity Correction Quantity next, an example of correcting the fuel vapor quantity in accordance with the engine speed, will be explained referring to FIG. 6.

To start with, the engine speed NE and the accelerator aperture ACA are inputted (step 681). Next, the basic fuel injection quantity (QALL) is calculated in an interpolating manner in accordance with the input data (step 682). Namely, at first, the basic fuel injection quantity corresponding to the engine speed and the accelerator aperture is calculated in the interpolating manner from a map in which to prescribe a correlation between the engine speed, the accelerator aperture and the basic fuel injection quantity (which are not shown).

It is judged in step 683 whether in the process of purging or not, and, if judged to be in the process of purging, the throttle aperture TA and the engine speed NE are taken in (step 684).

Figure 7:
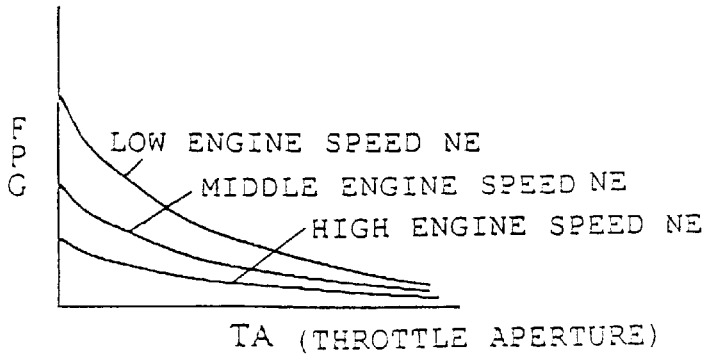
FIG. 7 is a diagram showing a map in which to prescribe a relationship between a throttle aperture TA, a fuel vapor quantity correction quantity FPG and an engine speed NE.

Next, the fuel vapor quantity correction quantity FPG) is calculated (step 685). This calculation is performed based on the correlation (see FIG. 7) between the throttle aperture TA, the engine speed NE and the fuel vapor quantity correction quantity (FPG) which are previously stored in the ROM in the form of a map. Note that HIGH , MIDDLE and LOW each imply the engine speed. When the engine speed is low, the fuel vapor quantity correction quantity increases.

Subsequently, if judged not to be in the process of purging in step 683, the fuel vapor quantity correction quantity is set to 0" in step 687.

After the fuel vapor quantity correction quantity (FPG) has been determined in steps 685 and 687, the processing proceeds to step 686, in which the last fuel injection quantity (QALLINJ) is determined by subtracting the fuel vapor quantity correction quantity (FPG) from the basic fuel injection quantity (QALL) previously calculated in step 682.

Thereafter, the fuel injection is implemented according to a specially set fuel injection program.

Figure 8:
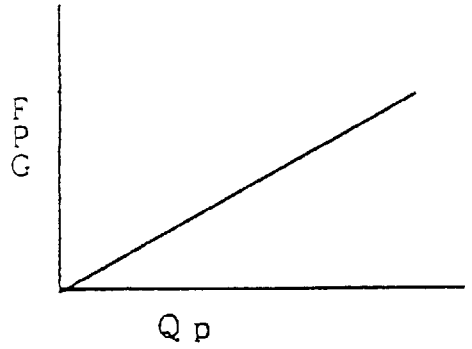
FIG. 8 is a diagram showing a map in which to prescribe a relationship between the fuel vapor quantity correction quantity FPG and a purge gas quantity Qp.
Figure 9:
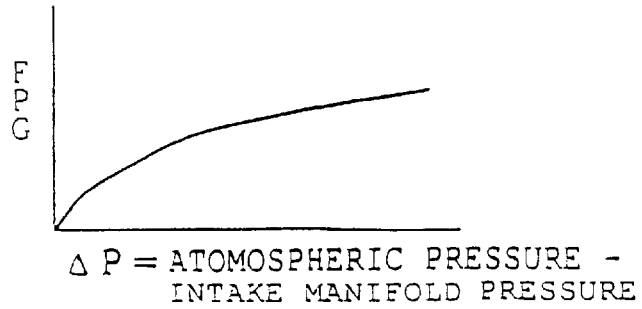
FIG. 9 is a diagram showing a map in which to prescribe a correlation between the fuel vapor quantity correction quantity FPG and a pressure difference between an atomospheric pressure and an intake manifold pressure.

It is to be noted that the method of calculating otherwise the fuel vapor quantity correction quantity (FPG) may be exemplified such as a method by which FPG is, as shown in FIG. 8, obtained from a purge gas quantity Qp, and a method by which FPG is, as shown in FIG. 9, obtained from a pressure of an intake manifold.

Figure 6:
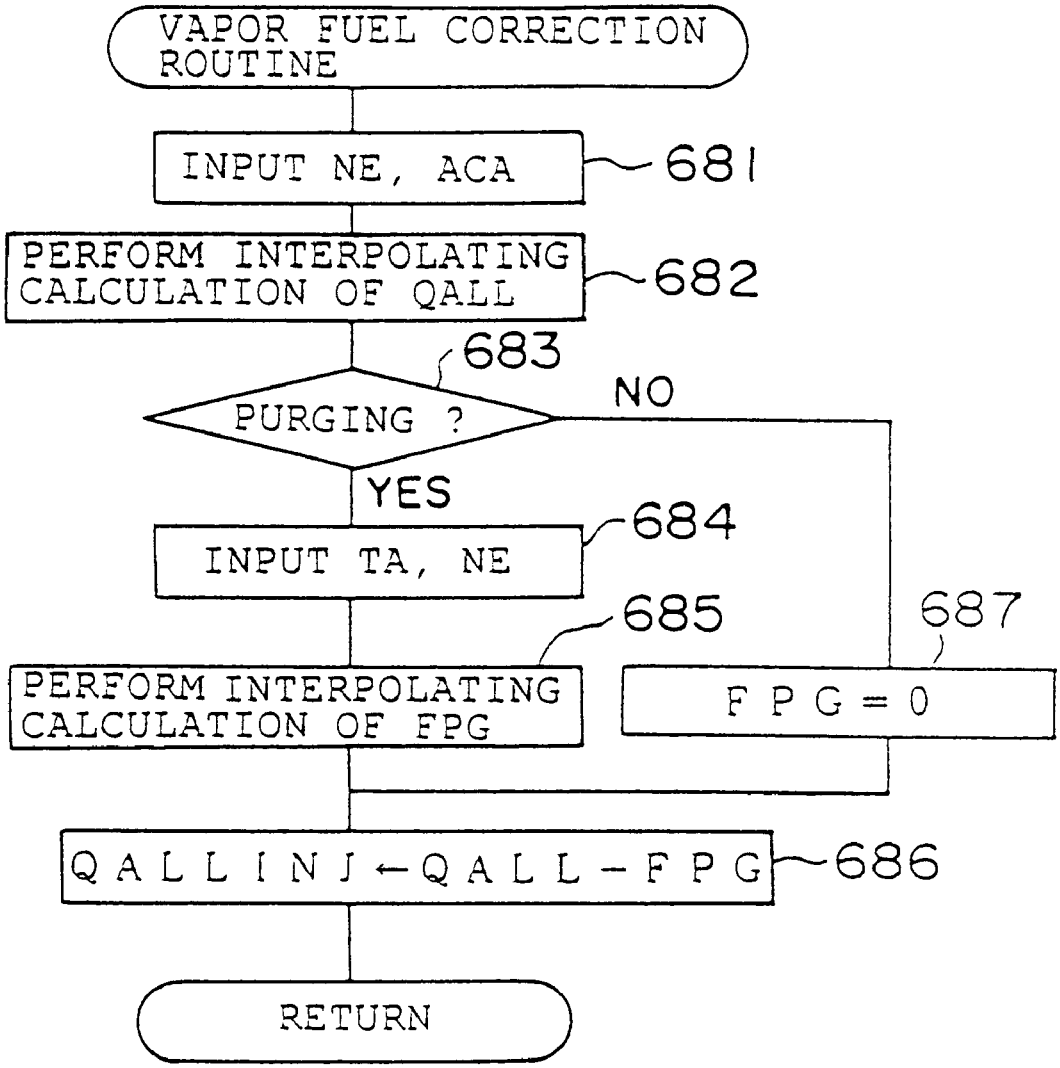
FIG. 6 is a flowchart showing the purge control routine based on a fuel injection quantity correction quantity.

Note that the routine shown in FIG. 6 is repeatedly executed at an interval of a predetermined time.

With such a correction routine, especially in steps 684 and 685, the fuel vapor quantity correction quantity is detected, and the correction is effected. It is therefore feasible to process a large amount of fuel vapor without exerting an influence upon the drivability and the emission.

First Embodiment

Herein, at the first onset, a concentration detecting module used in a first embodiment will be discussed.

Figure 10:
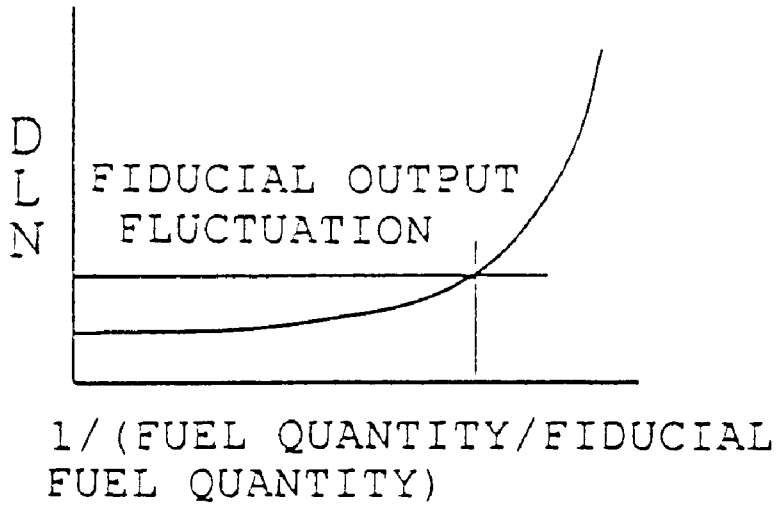
FIG. 10 is a diagram showing a map in which to prescribe a relationship between an output fluctuation DLN and a fuel quantity.

The concentration detecting module has, as shown in FIG. 10, a map in which to set a relationship between a magnitude of an output fluctuation (a torque fluctuation) DLN and a fuel quantity, or has functions. A case where the air/fuel ratio is in a lean region implies that the fuel quantity is small when the output fluctuates greatly, i.e., this is a lean state where the concentration of the air/fuel mixture is lean, and this more essentially implies that the fuel vapor quantity is small or that the concentration of the fuel vapor is lean. This implication is based on the experiments conducted by the present inventors.

Figure 11:
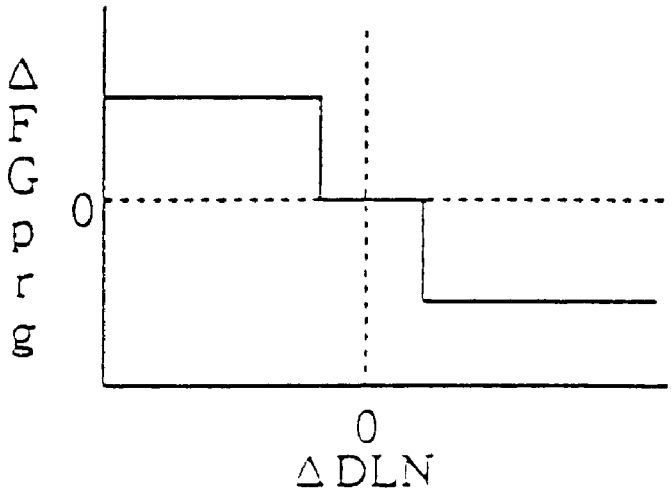
FIG. 11 is a diagram showing a map in which to prescribe a relationship between an output fluctuation quantity ΔDLN and a concentration correction value ΔFGprg.

Herein, a basic output fluctuation is set, and, even if the purging is executed when the output fluctuation is larger than this basic output fluctuation, there must be a lean state. It is therefore judged that a fuel vapor concentration FGprg is lean. Namely, as obvious from step 699, since the fuel vapor exhibits the lean concentration, the last fuel injection quantity QALLINJ is increased, more specifically, as shown in FIG. 11, the ROM is stored with a relationship between an output fluctuation quantity f¢DLN and a concentration correction quantity f¢FGprg in the form of a map. This relationship is also empirically obtained. Note that the output fluctuation (the torque fluctuation) in this embodiment is detected from a change quantity of the engine speed NE of the internal combustion engine which is obtained by the crank angle sensor 28. The output fluctuation can be otherwise obtained also from a change in the torque which is detected by a torque sensor at the crank shaft of the internal combustion engine, and from a change in the combustion pressure in the combustion chamber.

What has been described so far is the map for estimating the fuel vapor concentration, and the purge control utilizing this map will hereinafter be explained.

An example of correcting the fuel injection quantity in accordance with the fuel vapor quantity correction quantity FPG, will be described referring to FIG. 12.

Herein, the last fuel injection quantity (QAALLINJ) of the fuel finally supplied from the fuel injection valve is given by:

Last Fuel Injection Quantity QALLINJ=Basic Fuel Injection Quantity QALL−Fuel vapor Quantity Correction Quantity FPG Formula (1)

Accordingly, as the fuel vapor quantity correction quantity FPG increases, the last fuel injection quantity (QALLINJ) decreases, and the air/fuel mixture exhibits a much leaner air/fuel ratio. As the fuel vapor quantity correction quantity FPG decreases, the last fuel injection quantity (QALLINJ) increases, and the air/fuel ratio has a much richer air/fuel ratio.

At first, the engine speed NE and the accelerator aperture ACA are inputted (step 690). Subsequently, the basic fuel injection quantity (QALL) is calculated in the interpolating manner in accordance with the input data (step 691).

Figure 13:
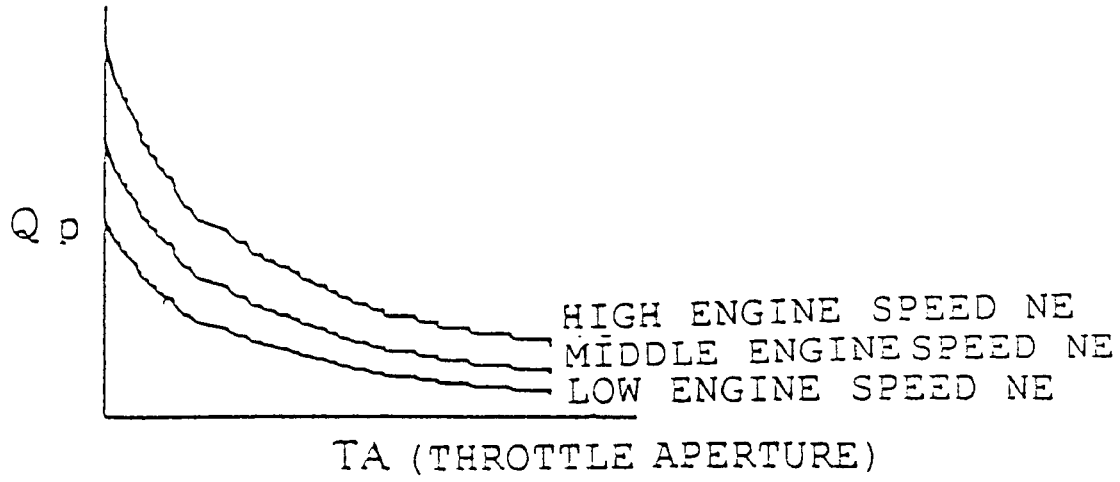
FIG. 13 is a diagram showing a map in which to prescribe a relationship between the purge gas quantity, the throttle aperture TA and the engine speed.

It is judged in step 692 whether in the process of purging or not. If judged to be in the process of purging, a purge gas quantity Qp of the purge gas composed of the air and the fuel vapor is calculated (step 693). This calculation is done based on a correlation (see FIG. 13) between the throttle aperture TA and the purge gas quantity which are previously stored in the form of a map in the ROM. Incidentally, referring to FIG. 13, HIGH MIDDLE and LOW each imply the engine speed. As the engine speed becomes higher, the purge gas quantity gets larger.

Subsequently, the present output fluctuation is detected, and the output fluctuation quantity f¢DLN is obtained by subtracting an output fluctuation DLN0 of the last time from the present output fluctuation DLN. Thereafter, a fuel vapor concentration detecting module calculates the fuel vapor concentration correction quantity ΔFGprg referring to the map in FIG. 11 (step 695).

Thereafter, in step 696, the fuel vapor quantity FGprg of this time is obtained by adding the fuel vapor concentration correction quantity ΔFGprg to the fuel vapor concentration of the last time.

Next, in step 697, the fuel vapor quantity correction quantity (FPG) is calculated. To be more specific, the purge gas quantity (QP) is multiplied by the fuel vapor concentration (FGprg), and a product thereof is divided by (Engine Speed (NE)×(n/2)), of which a quotient is set as a fuel vapor quantity. Note that n in this formula is the number of cylinders, and the reason why n is divided by 2 is that the air intake in a 4-cycle engine is effected twice during the four revolutions thereof.

When judged in step 692 not to be in the process of purging, the fuel vapor quantity correction quantity is set to 0" in step 698.

After the fuel vapor quantity correction quantity (FPG) has been determined in steps 697 and 698, the processing proceeds to step 699, in which the last fuel injection quantity (QALLINJ) is determined. Herein, the last fuel injection quantity (QALLINJ) is determined by subtracting the fuel vapor quantity correction quantity (FPG) from the basic fuel injection quantity (QALL) calculated in step 691. With the fuel injection quantity, the fuel injection is implemented according to the specially set fuel injection program.

Figure 12:
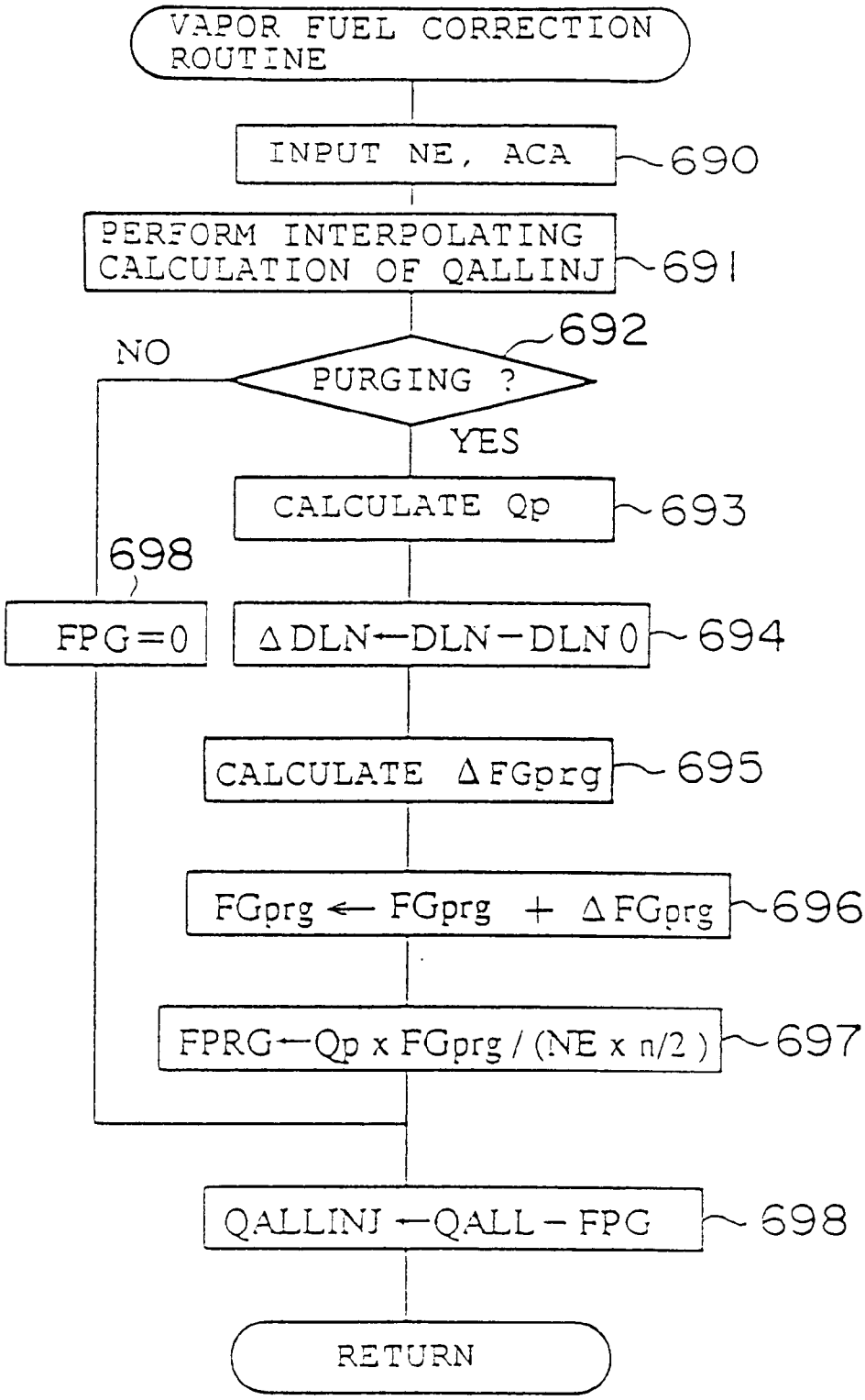
FIG. 12 is a flowchart showing an example of executing purge control by estimating a fuel vapor concentration from the output fluctuation and calculating the fuel vapor quantity correction quantity.

Note that the routine shown in FIG. 12 is repeatedly executed at an interval of a predetermined time. Incidentally, an injection timing is set for a period from an intake stroke to a compression stroke in accordance with the operating state of the engine.

Thus, the fuel vapor concentration is estimated from the output fluctuation, and the fuel vapor quantity correction quantity is calculated. It is therefore feasible to effect the purge control at a high accuracy even in such an air/fuel ratio region that the air/fuel ratio sensor is incapable of measuring and to process the fuel vapor without exerting an influence upon the drivability and the emission.

Second Embodiment

Change in Fuel Injection State with Correction of Fuel vapor Quantity

Next, a control example of changing a state of fuel injection with the correction of the fuel vapor quantity, will hereinafter be explained. It should be noted that the state of the fuel injection in a second embodiment implies a fuel injection quantity and a fuel injection angle.

Figure 14:
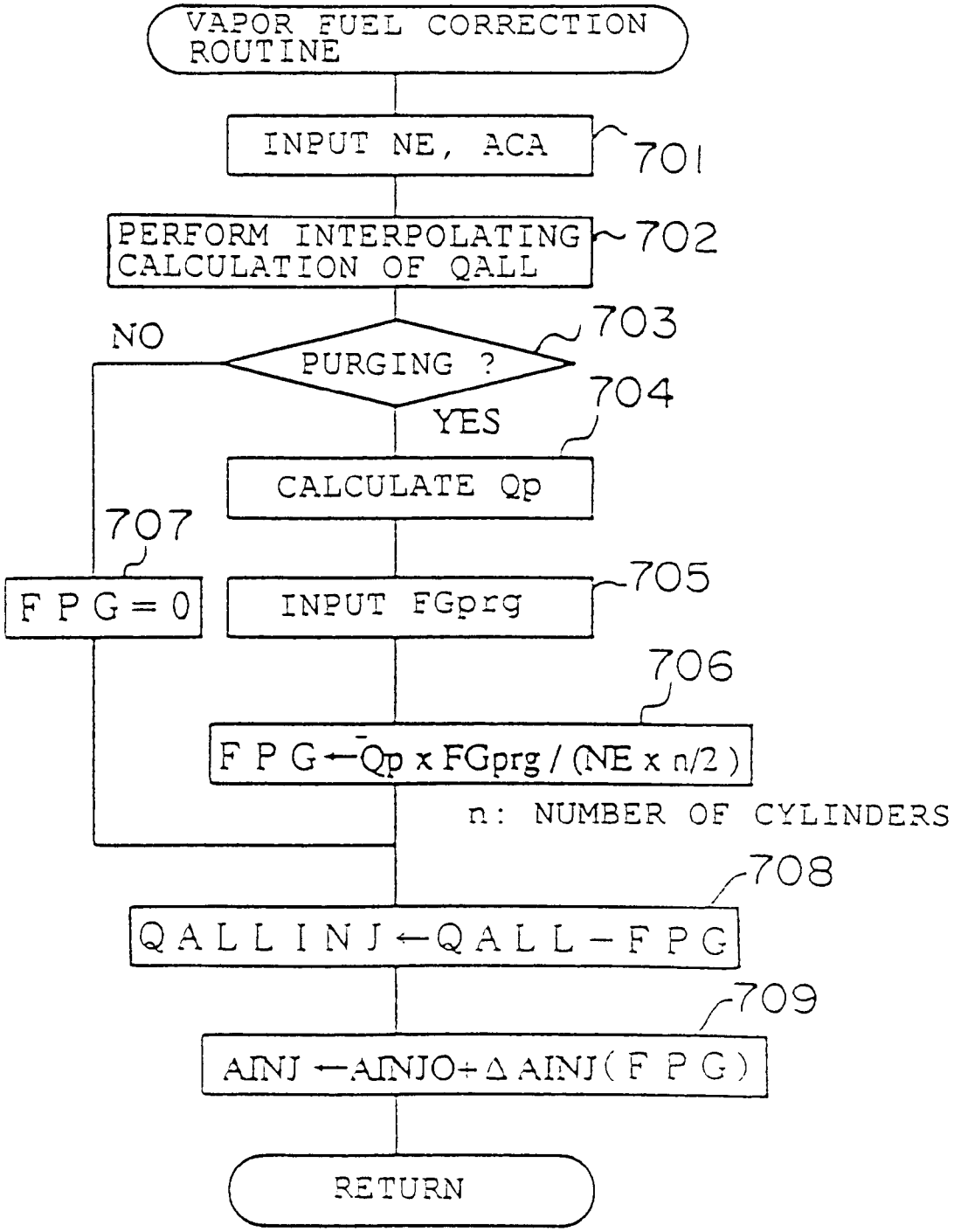
FIG. 14 is a flowchart showing an example of obtaining the fuel vapor quantity correction quantity from the fuel vapor concentration, and controlling the fuel injection quantity and the fuel injection timing on the basis of the correction quantity.

As shown in FIG. 14, at first, the engine speed NE and the accelerator aperture ACA are inputted (step 701). Subsequently, the basic fuel injection quantity (QALL) is calculated in the interpolating manner in accordance with the input data (step 702).

It is judged in step 703 whether in the process of purging or not. If judged to be in the process of purging, the purge gas quantity Qp of the purge gas composed of the air and the fuel vapor is calculated (step 704). This calculation is done based on the correlation (see FIG. 13) between the throttle aperture TA and the purge gas quantity which are previously stored in the form of the map in the ROM.

Subsequently, the fuel vapor concentration (FGprg) is calculated (step 705). The calculating method thereof is the same as the one used in steps 695 and 696 in FIG. 12.

Thereafter, in step 706, the fuel vapor quantity correction quantity (FPG) is calculated. To be more specific, the purge gas quantity (QP) is multiplied by the fuel vapor concentration (FGprg), and a product thereof is divided by (Engine Speed (NE)×(n/2)), of which a quotient is set as a fuel vapor quantity. Note that n in this formula is the number of cylinders, and the reason why n is divided by 2 is that the air intake in the 4-cycle engine is effected twice during the four revolutions thereof.

When judged in step 703 not to be in the process of purging, the fuel vapor quantity correction quantity is set to 0" in step 707.

Figure 15:
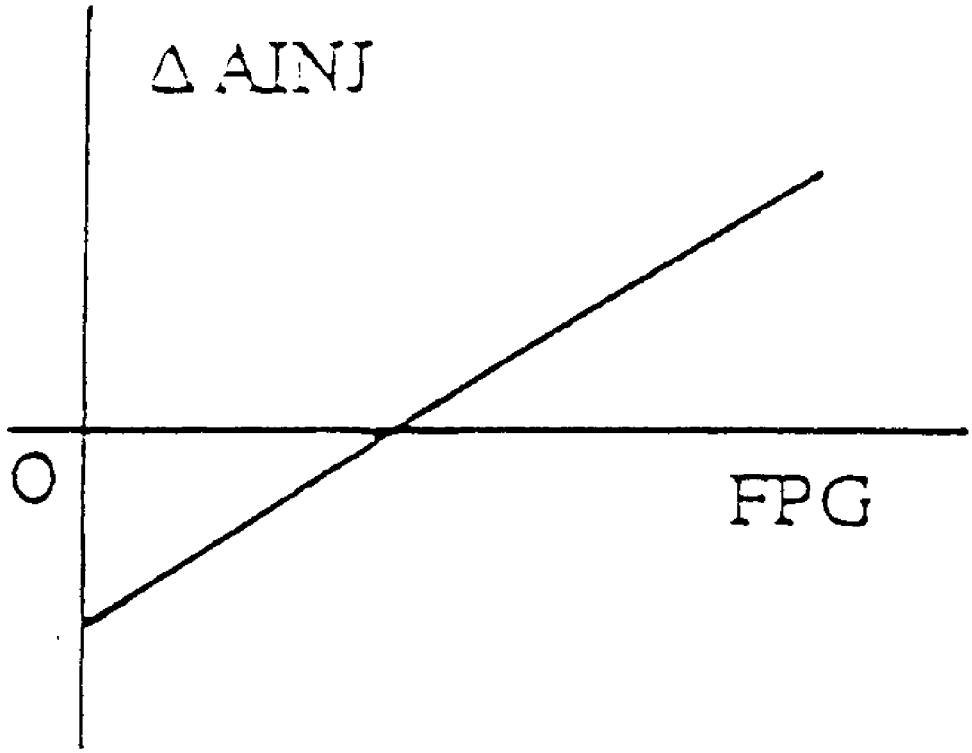
FIG. 15 is a diagram showing a map in which to prescribe a relationship between a change quantity ΔAINJ of a fuel injection angle and the fuel vapor quantity.

After the fuel vapor quantity correction quantity (FPG) has been determined in steps 706 and 707, the processing proceeds to step 708, in which the last fuel injection quantity (QALLINJ) is determined. Herein, the last fuel injection quantity (QALLINJ) is determined by subtracting the fuel vapor quantity correction quantity (FPG) from the basic fuel injection quantity (QALL) calculated in step 702. Further, a fuel injection angle (a crank angle at fuel injection start timing) is determined in step 709. On the occasion of determining the fuel injection angle (AINJ), a map shown in FIG. 15 is referred to. This map previously prescribes a correlation between the fuel vapor quantity correction quantity (FPG) and a change quantity (ΔAINJ) of the fuel injection angle, and is stored in the ROM. Referring again to FIG. 15, a cross point between the graph and the axis of abscissas indicates a stoichimetric air/fuel ratio. A left part from this cross point implies that only the air is purged. Namely, the fuel injection angle of this time is calculated by subtracting the change quantity (ΔAINJ) of the fuel injection angle which corresponds to the fuel vapor quantity correction quantity (FPG) from the fuel injection angle (AINJO) of the last time. With the thus obtained fuel injection angle, the fuel injection is implemented according to the specially set fuel injection program.

Note that the routine shown in FIG. 14 is repeatedly executed at an interval of a redetermined time.

The fuel injection angle in addition to the fuel injection quantity is controlled based on the above-described correction routine, and thereafter the output fluctuation is detected. Hence, the accuracy of detecting the fuel vapor concentration is enhanced, and further it is possible to process the large quantity of fuel vapor with the preferable drivability and emission without exerting the influence thereon.

Third Embodiment

An essentiality of a third embodiment is that when the purge gas fuel concentration FGprg is estimated from the output fluctuation, a detection thereof is executed each time the purging is started and with every elapse of a predetermined time.

Further, the output fluctuations, of which an average is taken at an interval of a predetermined time, are thus measured.

Figure 16:
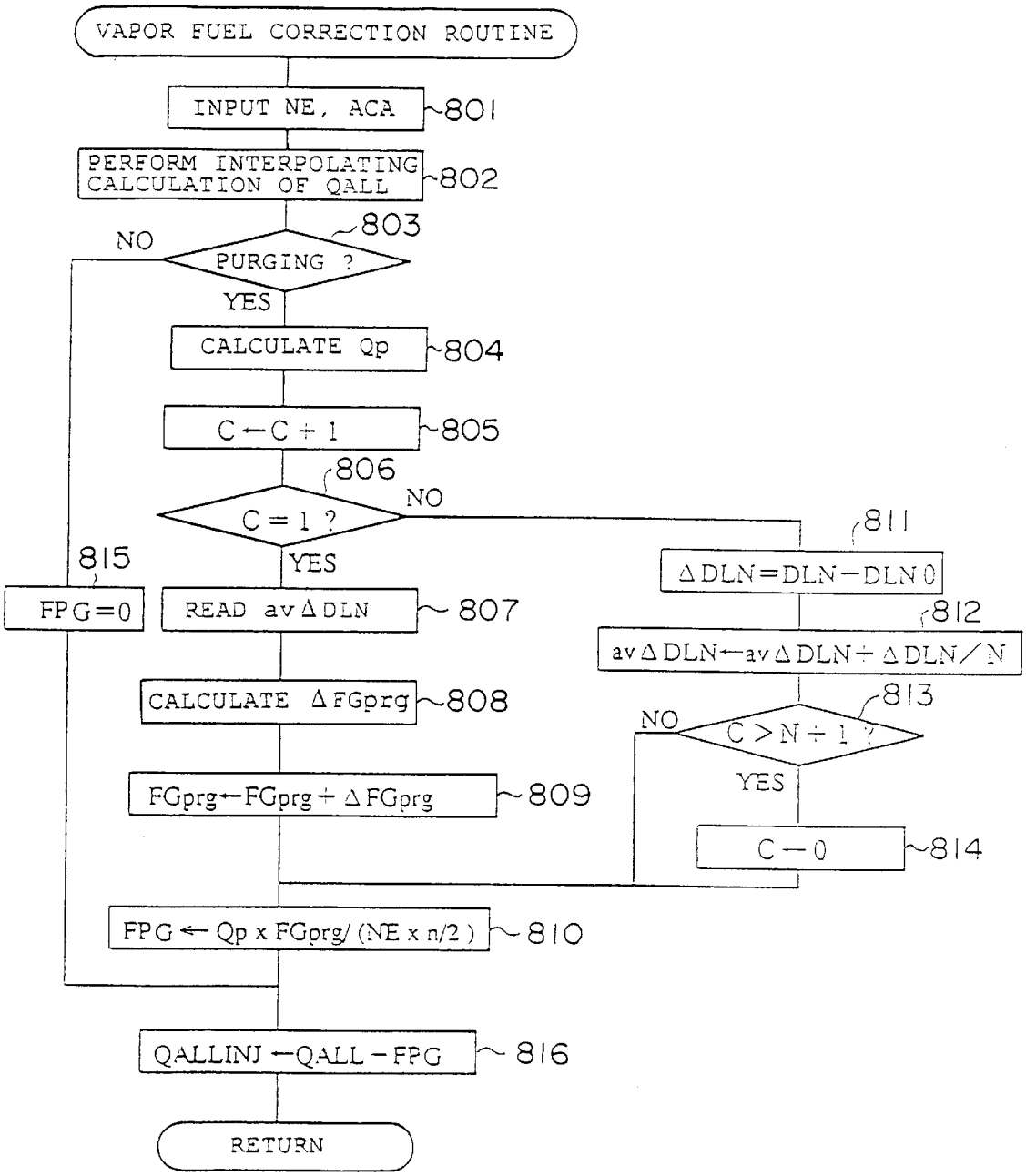
FIG. 16 is a flowchart showing a third embodiment.

As shown in FIG. 16, to begin with, the engine speed NE and the accelerator aperture ACA are inputted (step 801). Subsequently, the basic fuel injection quantity (QALL) is calculated in the interpolating manner in accordance with the input data (step 802).

It is judged in step 803 whether in the process of purging or not. If judged to be in the process of purging, the purge gas quantity Qp of the purge gas composed of the air and the fuel vapor is calculated (step 804). This calculation is done based on the correlation (see FIG. 13) between the throttle aperture TA and the purge gas quantity which are previously stored in the form of the map in the ROM.

Subsequently, a value C of a counter is incremented by 1" (step 805). It is judged in step 806 whether or not the count value C is 1". If the value C is 1", the average of the output fluctuations at the interval of the predetermined time is read (step 807). The output fluctuations are detected at all times by the operating state detecting module M7 serving as an output fluctuation detecting module, and the average thereof at the interval of the predetermined time is calculated by another routine at the interval of the predetermined time.

Figure 17:
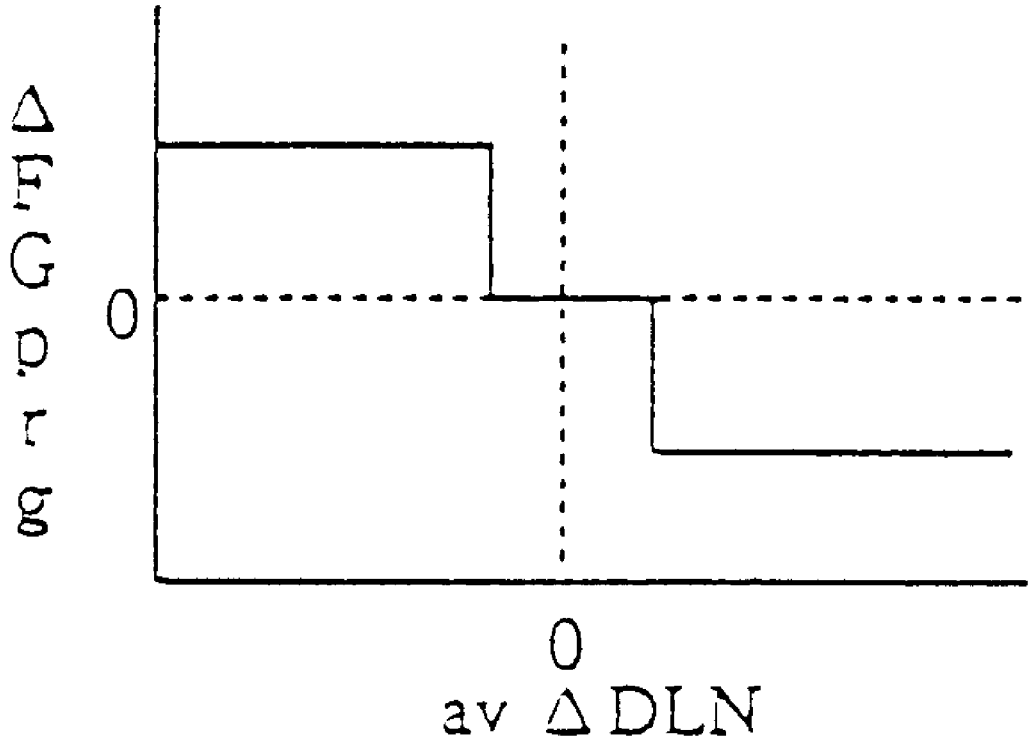
FIG. 17 is a diagram showing a map in which to prescribe a relationship between the output fluctuation and the fuel vapor concentration correction value.

After reading the average of the output fluctuations, the fuel vapor concentration correction quantity ΔFGprg as a fuel vapor concentration correction value is calculated from a map shown in FIG. 17 (step 808). The map in FIG. 17 shows a relationship between an output fluctuation average value av ΔDLN and the fuel vapor concentration correction value ΔFGprg. This map is previously stored in the ROM. As apparent from this map, the output fluctuation average is under 0", and a negative value becomes large, in which case a positive correction value is given. When the output fluctuation average is over 0" and a positive value becomes large, a negative correction value is given. If the output fluctuation average is in the vicinity of 0", this is conceived as a dead zone, and a correction value 0" is given. A critical point showing whether the correction value is 0" or not, is empirically obtained.

When the fuel vapor concentration correction quantity ΔFGprg is determined, this correction quantity is added to the fuel vapor concentration correction quantity FGprg calculated last time, thereby obtaining a new fuel vapor concentration (step 809). Thereafter, the fuel vapor quantity correction quantity (FPG) is calculated in step 810. Thereafter, in step 810, the fuel vapor quantity correction quantity (FPG) is calculated. To be more specific, the purge gas quantity (QP) is multiplied by the fuel vapor concentration (FGprg), and a product thereof is divided by (Engine Speed (NE)×(n/2)), of which a quotient is set as a fuel vapor quantity. Note that n in this formula is the number of cylinders, and the reason why n is divided by 2 is that the air intake in the 4-cycle engine is effected twice during the four revolutions thereof.

When judging in step 806 that C is not 1", the processing proceeds to step 811, in which the output fluctuation quantity ΔDLN is obtained by subtracting the output fluctuation DLN0 of the last time from the present output fluctuation DLN. Subsequently, a divided value ΔDLN/N of the output fluctuation quantity ΔDLN of this time is added to the average value avΔDLN of the output fluctuation quantities ΔDLN obtained when executing the routine of the last time, and an added result thereof is set as an output fluctuation average value av ΔDLN of this time. Herein, N is an arbitrary value indicating a fuel vapor concentration calculation period.

Thereafter, it is judged whether or not the count value C obtained in step 805 is larger than N+1 (step 812). If the count value C is larger than N+1, the count value C is initialized to 0" (step 814) , and the processing proceeds to step 810. When judging in step 813 that the count value C is under N+1, the processing advances directly to step 810. What is calculated last time as the fuel vapor concentration FGprg is used in step 810 via the steps 813 and 814.

Note that if judged in step 803 not to be in the process of purging, the fuel vapor quantity correction quantity is set to 0" in step 815.

After the fuel vapor quantity correction quantity (FPG) has been determined in steps 810 and 815, the processing proceeds to step 816, in which the last fuel injection quantity (QALLINJ) is determined. Herein, the last fuel injection quantity (QALLINJ) is determined by subtracting the fuel vapor quantity correction quantity (FPG) from the basic fuel injection quantity (QALL) calculated in step 802.

Incidentally, it is indicated that the detection of the fuel vapor concentration is implemented when starting the purge from step 806 onward. Further, as obvious from steps 813 and 814, the count value C is initialized each time this routine is executed (N+1) times, i.e., at the interval of the predetermined time. The fuel vapor concentration is detected in steps 807 through 809 on the occasion of executing the program thereafter.

The output fluctuations are averaged at the interval of the predetermined time, and hence the sampling becomes gentle. In the third embodiment, the change in the concentration of the fuel vapor may be a slower phenomenon than the output fluctuation, and therefore the sampling is effected gently, thereby making is feasible to restrain hunting of the concentration detected value that is attributed to an error of the output fluctuation due to factors other than the basic fuel.

Fourth Embodiment

A fourth embodiment exemplifies a case in which the purge gas fuel concentration FGprg is, when estimated from the output fluctuation, detected under a predetermined operating condition where particularly the output fluctuation other than purging is small, i.e., the combustion is stabilized. The case where the output fluctuation is small, implies such an operating condition that, for example, the engine speed is higher than in a middle engine speed region.

Figure 18:
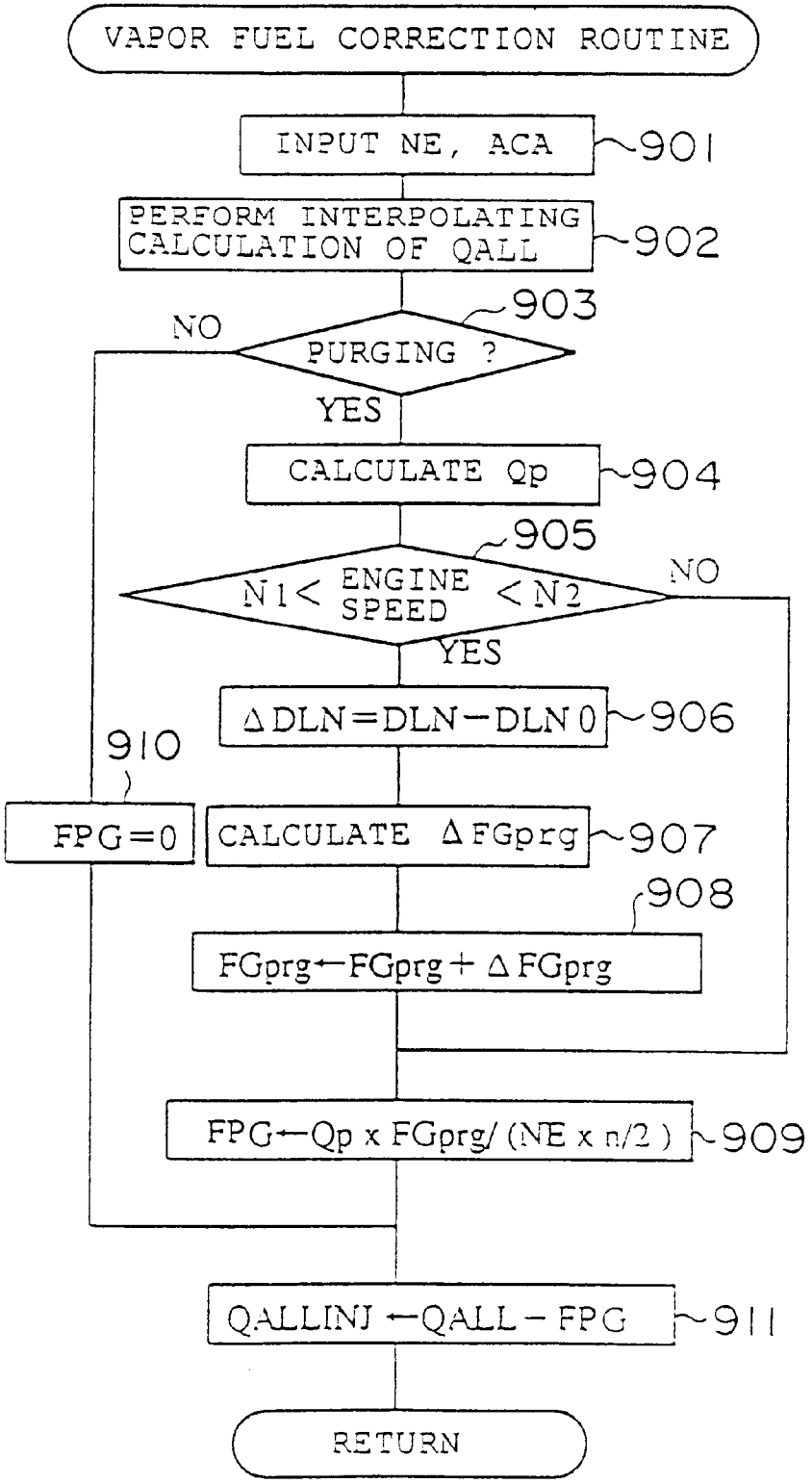
FIG. 18 is a flowchart showing a fourth embodiment.

As shown in FIG. 18, to begin with, the engine speed NE and the accelerator aperture ACA are inputted (step 901). Subsequently, the basic fuel injection quantity (QALL) is calculated in the interpolating manner in accordance with the input data (step 902).

It is judged in step 903 whether in the process of purging or not. If judged to be in the process of purging, the purge gas quantity Qp of the purge gas composed of the air and the fuel vapor is calculated (step 904). This calculation is done based on the correlation (see FIG. 13) between the throttle aperture TA and the purge gas quantity which are previously stored in the form of the map in the ROM.

Figure 19:
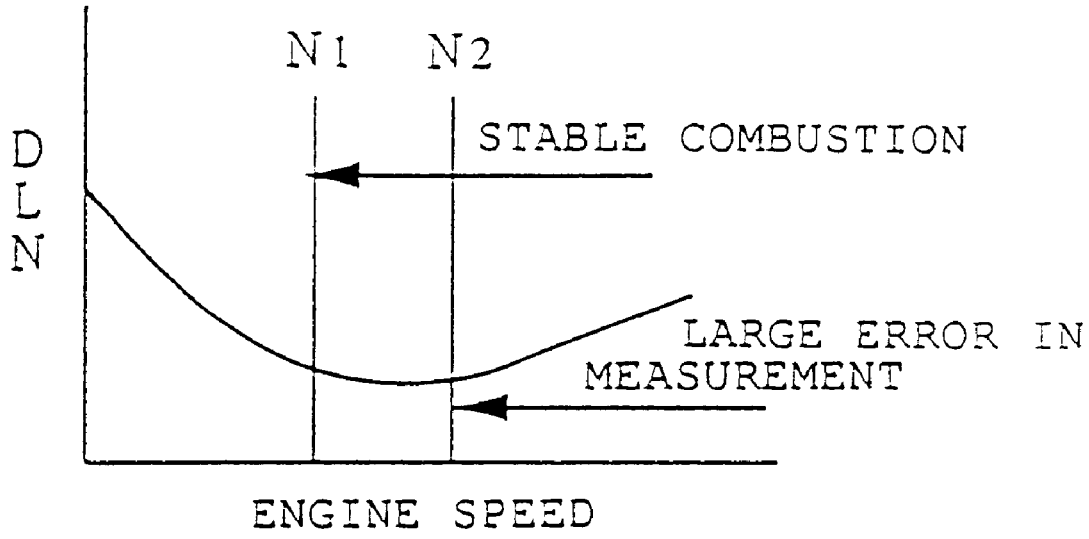
FIG. 19 is a graphic chart showing a relationship between the engine speed and the output (torque) fluctuation.

Next, it is judged whether or not the engine speed NE is larger than N1 but smaller than N2 (step 905). Herein, as shown in FIG. 19, N1 and N2 are lower and upper limit values in a range where the output fluctuation remains stable. A combustion stability is obtained when the engine speed is over N1. If over N2, however, an error in the measurement of the output fluctuation becomes large, resulting in a decline of the correction accuracy.

If the engine speed is in a middle speed region between N1 and N2 (N1=2000, and N2=3000), the present output fluctuation is detected in step 906, and the output fluctuation quantity ΔDLN is obtained by subtracting the output fluctuation DLN0 of the last time from the present output fluctuation DLN. Thereafter, the fuel vapor concentration correction quantity ΔFGprg is calculated from the map shown in FIG. 17 (step 907).

When the fuel vapor concentration correction quantity ΔFGprg is determined, this correction quantity is added to the fuel vapor concentration FGprg calculated last time, and an added result is set as a new fuel vapor concentration FGprg (step 908). Thereafter, the fuel vapor quantity correction quantity (FPG) is calculated in step 909. This calculation is the same as step 810 in the preceding embodiment.

When judging in step 905 that the engine speed does not fall within the N1–N2 range, the processing jumps from step 904 over step 908 to step 909. In this case, the fuel vapor concentration FGprg calculated last time is used in step 909.

Note that if judged in step 903 not to be in the process of purging, the fuel vapor quantity correction quantity is set to 0" in step 910.

After the fuel vapor quantity correction quantity (FPG) has been determined in steps 909 and 910, the processing proceeds to step 911, in which the last fuel injection quantity (QALLINJ) is determined. Herein, the last fuel injection quantity (QALLINJ) is determined by subtracting the fuel vapor quantity correction quantity (FPG) from the basic fuel injection quantity (QALL) calculated in step 902.

As discussed above, in step 905, the operation condition is limited to the region where the output fluctuation excluding the purge, and hence the output fluctuation due to the purging appears to be larger than in the case of no limitation. Therefore, if the concentration is detected under such a condition, the vapor concentration detection accuracy is enhanced. Besides, because of being limited to the above region where the output fluctuation other than the purging is small, the influence of the output fluctuation due to the purging appears to be large, and consequently the detection for the purge control is easy to perform.

Figure 20:
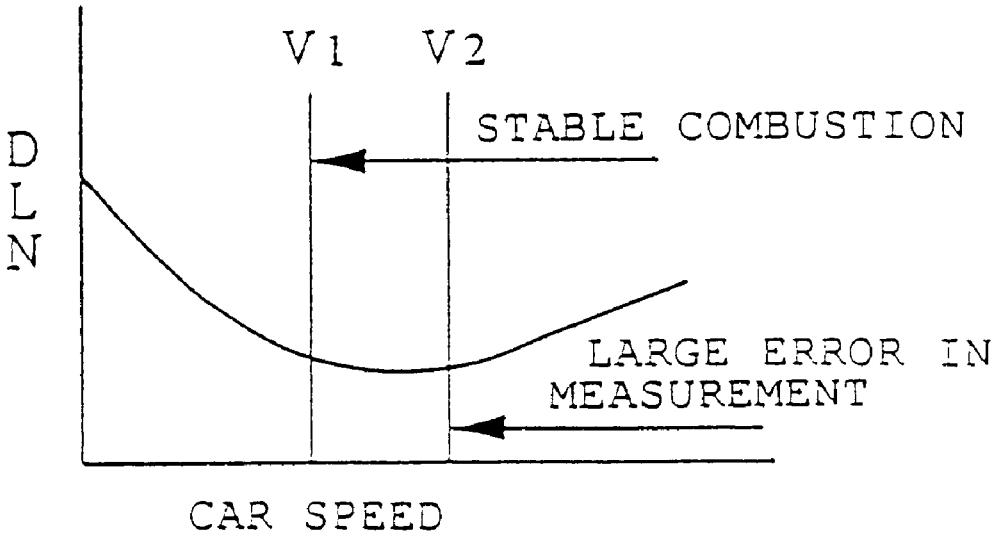
FIG. 20 is a graphic chart showing a relationship between the car speed and the output (torque) fluctuation.

Note that it is judged in step 905 referring to FIG. 19 whether or not the engine speed falls within the N1–N2 range. A car speed may be, however, used as a substitute for the engine speed, and it may also be judged whether or not, as shown in FIG. 20, the car speed is within a V1–V2 range. Referring again to FIG. 20, V1 and V2 are (e.g., V1=40 km/h, and V2=80 km/h) are lower and upper limit values in a range where the output fluctuation remains stable. A combustion stability is obtained when the car speed is over V1. If over V2, however, an error in the measurement of the output fluctuation becomes large, resulting in a decline of the correction accuracy.

Fifth Embodiment

A fifth embodiment exemplifies a case in which the purge gas fuel concentration FGprg is, when estimated from the output fluctuation, detected when in the lean-burn wherein the internal combustion engine is operated at an air/fuel ratio leaner than the stoichimetric air/fuel ratio.

Figure 21:
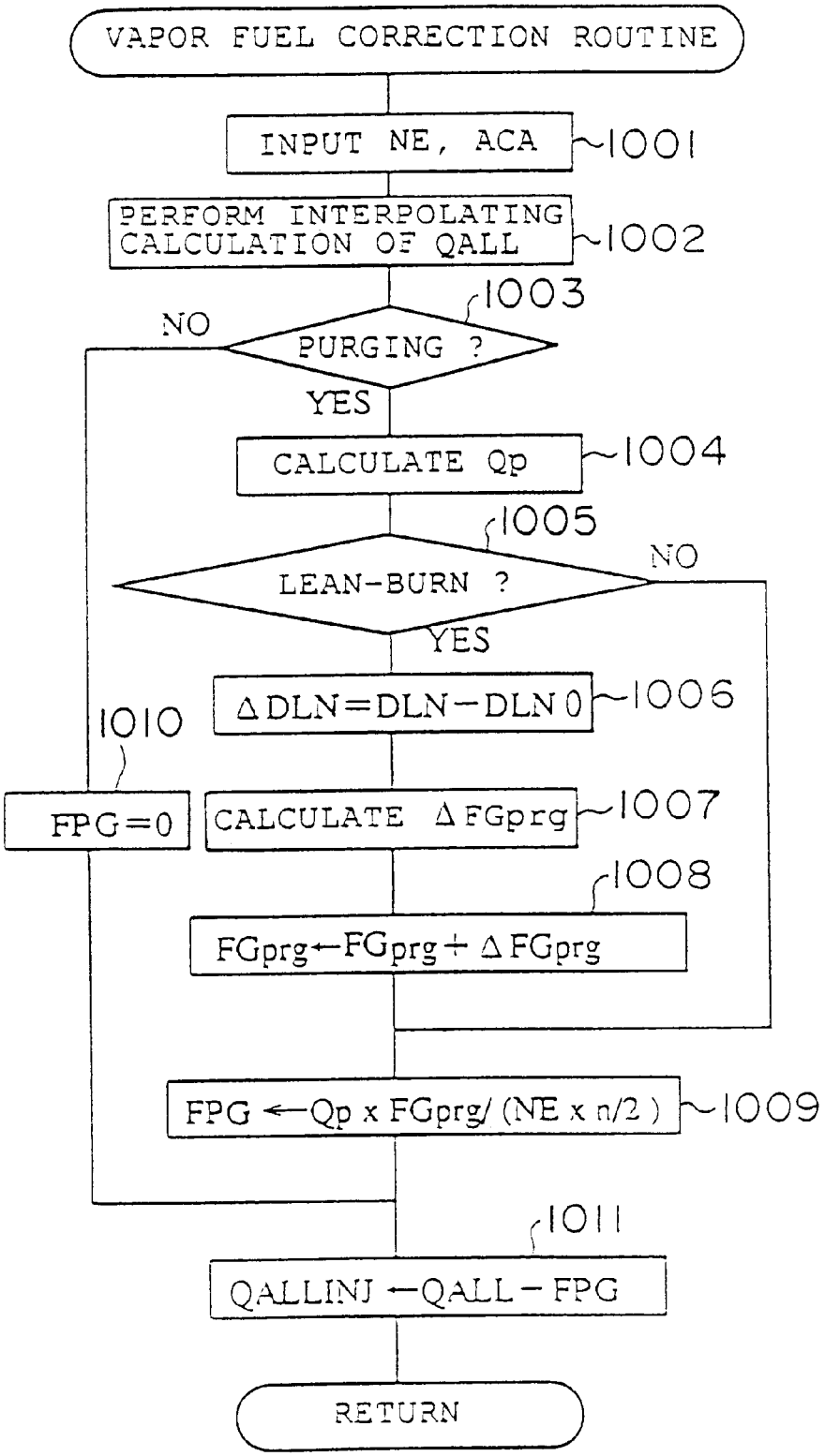
FIG. 21 is a flowchart showing a fifth embodiment.

As shown in FIG. 21, to begin with, the engine speed NE and the accelerator aperture ACA are inputted (step 1001). Subsequently, the basic fuel injection quantity (QALL) is calculated in the interpolating manner in accordance with the input data (step 1002).

It is judged in step 1003 whether in the process of purging or not. If judged to be in the process of purging, the purge gas quantity Qp of the purge gas composed of the air and the fuel vapor is calculated (step 1004). This calculation is done based on the correlation (see FIG. 13) between the throttle aperture TA and the purge gas quantity which are previously stored in the form of the map in the ROM.

Figure 22:
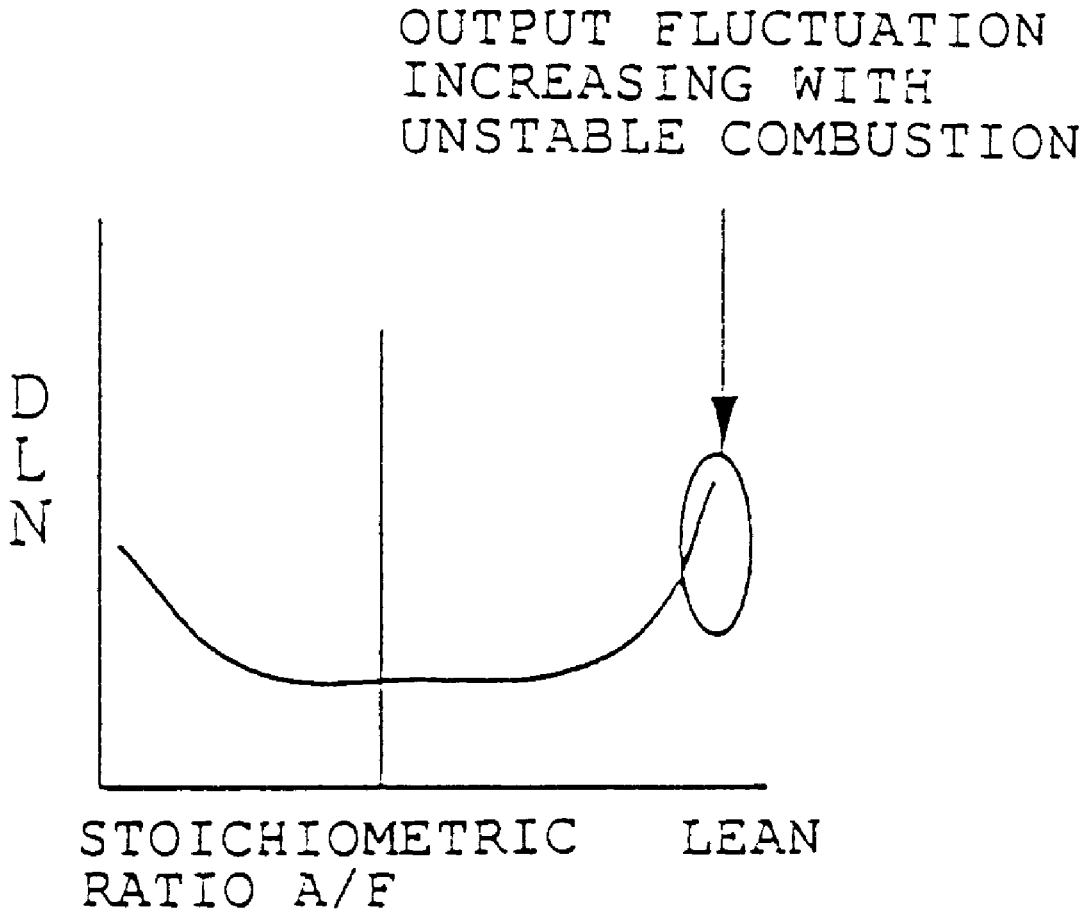
FIG. 22 is a graphic chart showing a relationship between an air/fuel ratio and the output (torque) fluctuation.

Next, it is judged whether or not a combustion state of the engine is a lean-burn state (step 1005). Whether in the lean-burn state or not is judged by setting a flag and based on this flag for showing the lean-burn state when becoming the lean-burn state under, e.g., the fuel injection control. The reason for making such a judgement is that the output fluctuation is, as shown in FIG. 22, stable in the vicinity of the stoichimetric air/fuel ratio (a stoichiometric ratio), however, the combustion becomes unstable, and the output fluctuation becomes large if a degree both of being lean and being rich is large. Of these cases, if the degree of being rich is large, and if the concentration of the fuel vapor abruptly becomes rich, the degree of richness further increases, with the result that the output fluctuation becomes larger, which is unsuitable for detecting the concentration. By contrast, if the degree of being lean is large, the concentration of the fuel vapor abruptly becomes rich. Even when becoming rich, the output fluctuation is still stable, and therefore this is suitable for detecting the concentration.

Accordingly, when in the lean-burn state, the present output fluctuation is detected in step 1006, and the output fluctuation quantity ΔDLN is obtained by subtracting the output fluctuation DLN0 of the last time from the present output fluctuation DLN. Thereafter, the fuel vapor concentration correction quantity ΔFGprg is calculated from the map shown in FIG. 17 (step 1007).

When the fuel vapor concentration correction quantity ΔFGprg is determined, this correction quantity is added to the fuel vapor concentration FGprg calculated last time, and an added result is set as a new fuel vapor concentration FGprg (step 1008). Thereafter, the fuel vapor quantity correction quantity (FPG) is calculated in step 1009. This calculation is the same as step 810 in the preceding embodiment.

When judging in step 1006 that the engine is not in the lean-burn state, the processing jumps from step 1006 over step 1008 to step 1009. In this case, the fuel vapor concentration FGprg calculated last time is used in step 1009.

Note that if judged in step 1003 not to be in the process of purging, the fuel vapor quantity correction quantity is set to 0" in step 1010.

After the fuel vapor quantity correction quantity (FPG) has been determined in steps 1009 and 1010, the processing proceeds to step 1011, in which the last fuel injection quantity (QALLINJ) is determined. Herein, the last fuel injection quantity (QALLINJ) is determined by subtracting the fuel vapor quantity correction quantity (FPG) from the basic fuel injection quantity (QALL) calculated in step 1002.

As discussed above, the correction is limited to when in the lean-burn, thereby preventing a mis-detection of the concentration due to the richness. Namely, if detected in the rich air/fuel ratio region, as described above, there appears such a phenomenon that the combustion itself becomes unstable when the fuel concentration abruptly becomes rich, with the result that an error in the detected concentration of the fuel vapor might occur. In the fifth embodiment, however, the concentration is detected only when in the lean-burn state, and hence there is no possibility in which the concentration is mis-detected in the way described above.

Note that the lean-burn state in the fifth embodiment is that the air/fuel ratio A/F ranges from 14.5 to 22 (A/F=14.5 to 22) in the case of, e.g., the uniform lean-burn and ranges from 14.5 to 40 (A/F=14.5 to 40) if inclusive of the stratified charge combustion.

Sixth Embodiment

A sixth embodiment exemplifies a case where when the atmospheric pressure and a temperature of the intake air change, a fuel desorbing quantity from the canister varies, and the purge gas fuel concentration is remeasured if it is judged that there changes the concentration of the fuel vapor to be purged. After starting the measurement, the measurement is continuously performed a number of times with which to make it conceivable that the atmospheric pressure and the intake air temperature converge in the stable state.

Figure 23:
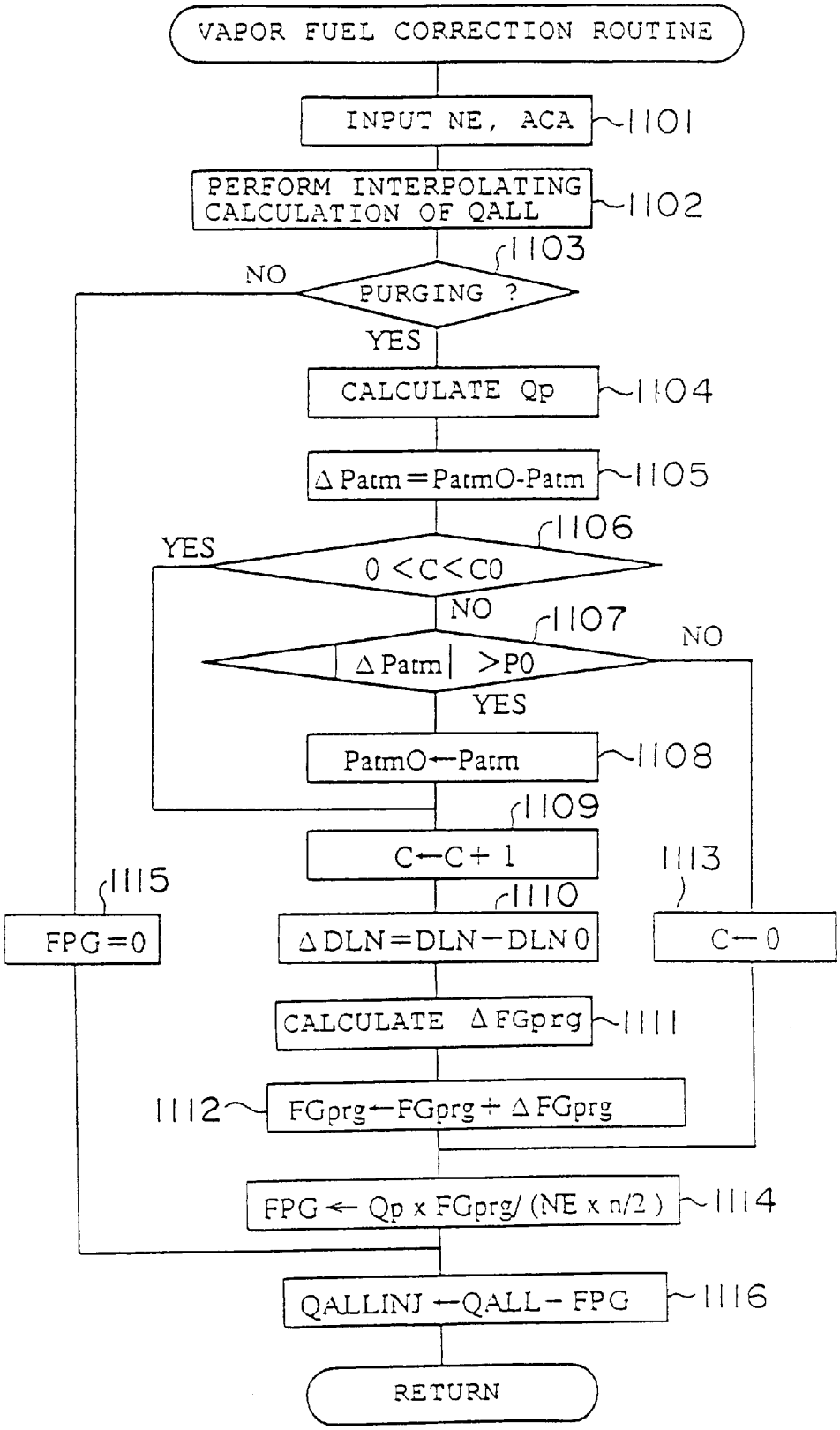
FIG. 23 is a flowchart showing a sixth embodiment.

As shown in FIG. 23, at the first onset, the engine speed NE and the accelerator aperture ACA are inputted (step 1101). Subsequently, the basic fuel injection quantity (QALL) is calculated in the interpolating manner in accordance with the input data (step 1102).

It is judged in step 1103 whether in the process of purging or not. If judged to be in the process of purging, the purge gas quantity Qp of the purge gas composed of the air and the fuel vapor is calculated (step 1104). This calculation is done based on the correlation (see FIG. 13) between the throttle aperture TA and the purge gas quantity which are previously stored in the form of the map in the ROM.

Next, in step 1105, an atmospheric pressure change quantity ΔPatm for a predetermined time is calculated by subtracting a present atmospheric pressure from an atmospheric pressure Patm detected by an atmospheric pressure sensor on the occasion of detecting the fuel vapor quantity correction quantity FPG when executing the program last time.

Thereafter, it is judged whether or not the count value C is larger than 0" but smaller than a number-of-purge-gas-concentration-measurements C0 (step 1106). If it is judged that the count value C is over 0 or C0, it is judged in step 1107 whether or not an absolute value of the atmospheric pressure change quantity ΔPatm is larger than a pressure fiducial value P0. Herein, C0 is a value empirically determined from a degree to which the atmospheric pressure changes. Further, the pressure fiducial value P0 is an empirically determined value. The change in the atmospheric pressure exerts an influence upon the desorbing quantity from the canister, and it is therefore judged whether or not there is a predetermined change as compared with the empirically determined fiducial value.

Then, if the absolute value of the atmospheric pressure change quantity ΔPatm is larger than the pressure fiducial value P0, the present atmospheric pressure is set as an atmospheric pressure Patm0 when detecting the fuel vapor quantity correction quantity FGprg (step 1108).

It is judged in step 1106 that the count value C is larger than 0 but less than C0, the processing jumps over steps 1107, 1108 directly to step 1109.

In step 1109, the count value C is incremented by 1". Subsequently, in step 1110, the present output fluctuation is detected, and the output fluctuation quantity ΔDLN is obtained by subtracting the output fluctuation DLN0 of the last time from the present output fluctuation DLN. Thereafter, the fuel vapor concentration correction quantity ΔFGprg is calculated from the map shown in FIG. 17 (step 1111).

When the fuel vapor concentration correction quantity ΔFGprg is determined, this correction quantity is added to the fuel vapor concentration FGprg calculated last time, and an added result is set as a new fuel vapor concentration FGprg (step 1112). Thereafter, the fuel vapor quantity correction quantity (FPG) is calculated in step 1114. This calculation is the same as step 810 in the preceding embodiment.

Note that when judging in step 1107 that the absolute value of the atmospheric pressure change quantity ΔPatm is under the pressure fiducial value P0, the count value C is initialized to 0" in step 1113, and the processing advances to step 1114. In step 1114 via step 1113, there is used the fuel vapor concentration FGprg calculated last time.

Note that if judged in step 1103 not to be in the process of purging, the fuel vapor quantity correction quantity is set to 0" in step 1115.

After the fuel vapor quantity correction quantity (FPG) has been determined in steps 1116 and 1115, the processing proceeds to step 1116, in which the last fuel injection quantity (QALLINJ) is determined. Herein, the last fuel injection quantity (QALLINJ) is determined by subtracting the fuel vapor quantity correction quantity (FPG) from the basic fuel injection quantity (QALL) calculated in step 1102.

Figure 24:
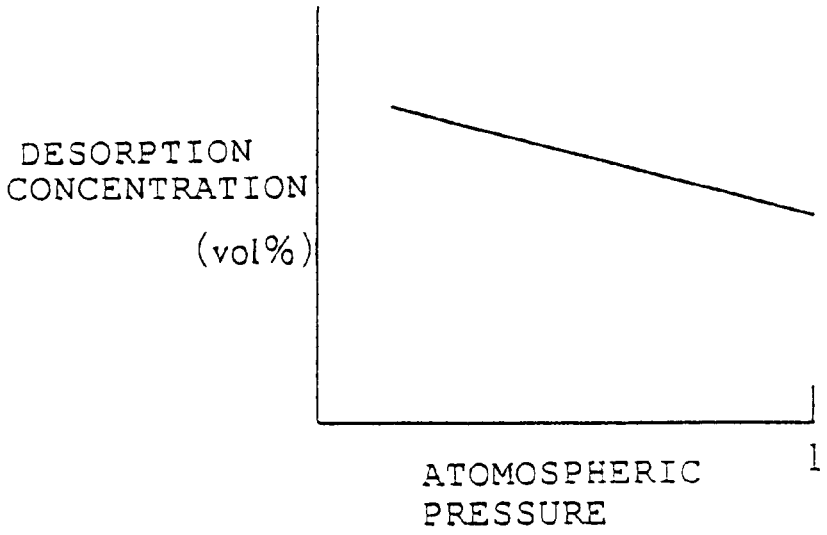
FIG. 24 is a graphic chart showing a relationship between the atomospheric pressure and a concentration of the fuel desorbed from a canister.

As obvious from step 1107, when the change quantity of the atmospheric pressure is large, the fuel vapor concentration is redetected, and hence the accuracy of detecting the concentration increases. Note that FIG. 24 is a diagram showing a relationship between the concentration of the fuel desorbed from the canister and the atmospheric pressure. It becomes apparent from FIG. 24 that the when the change in the atmospheric pressure is large, the concentration of the fuel desorbed from the canister varies.

Figure 25:
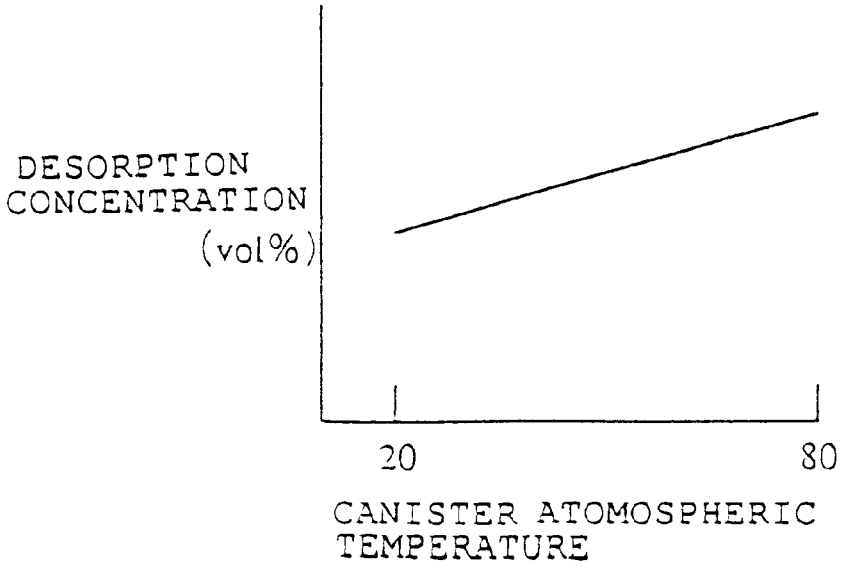
FIG. 25 is a graphic chart showing a relationship between a canister atmospheric air temperature and the concentration of the fuel desorbed from the canister.

Incidentally, as shown in FIG. 25, the concentration of the fuel desorbed from the canister might change also depending on a canister atmospheric temperature. Therefore, a change quantity of the canister atmospheric temperature is detected, and, when judging in step 1107 that an absolute value of the change quantity of the canister atmospheric temperature is larger than a predetermined fiducial value, the concentration of the fuel vapor may also be detected.

Seventh Embodiment

A seventh embodiment exemplifies a case where the purge gas fuel concentration FGprg is, when estimated from the output fluctuation, detected each time the purging is started and at an interval of a predetermined time. Then, when the concentration is low, and when the purge is started or resumes, a detection period is shortened. The output fluctuations are averaged at an interval of a predetermined time and thus measured.

Figure 26:
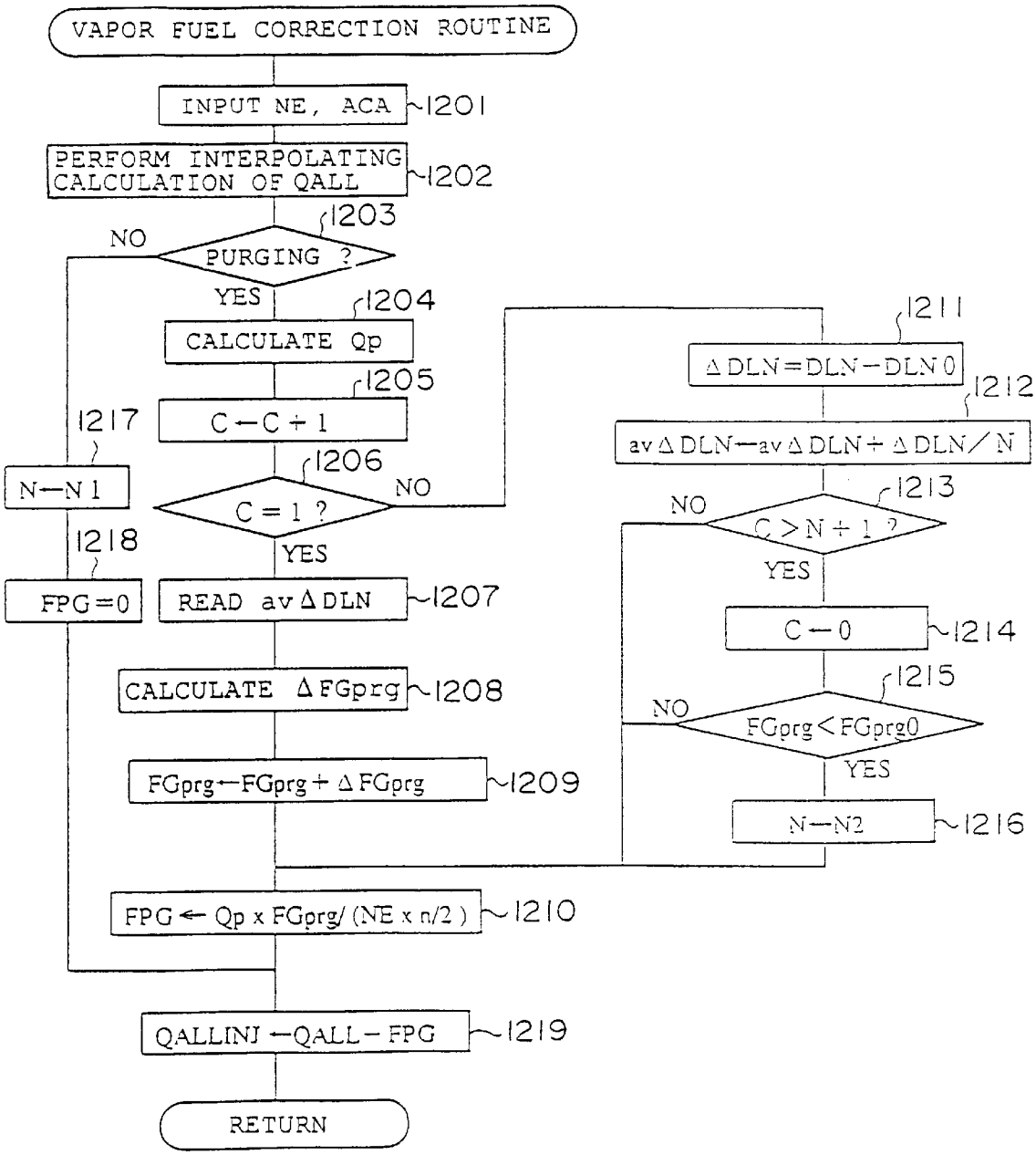
FIG. 26 is a flowchart showing a seventh embodiment.

As shown in FIG. 26, to begin with, the engine speed NE and the accelerator aperture ACA are inputted (step 1201). Subsequently, the basic fuel injection quantity (QALL) is calculated in the interpolating manner in accordance with the input data (step 1202).

It is judged in step 1203 whether in the process of purging or not. If judged to be in the process of purging, the purge gas quantity Qp of the purge gas composed of the air and the fuel vapor is calculated (step 1204). This calculation is done based on the correlation (see FIG. 13) between the throttle aperture TA and the purge gas quantity which are previously stored in the form of the map in the ROM.

Next, the value C of the counter is incremented by 1" (step 1205). It is judged in step 1206 whether or not the count value C is 1". If the value C is 1", the average of the output fluctuations at the interval of the predetermined time is read (step 1207). The output fluctuations are detected at all times by the operating state detecting module M7 serving as an output fluctuation detecting module, and the average thereof at the interval of the predetermined time is calculated by another routine at the interval of the predetermined time.

After reading the average of the output fluctuations, the fuel vapor concentration correction quantity ΔFGprg as the fuel vapor concentration correction value is calculated from the map shown in FIG. 17 (step 1208).

When the fuel vapor concentration correction quantity ΔFGprg is determined, this correction quantity is added to the fuel vapor concentration correction quantity FGprg calculated last time, thereby obtaining a new fuel vapor concentration (step 1209). Thereafter, the fuel vapor quantity correction quantity (FPG) is calculated in step 1210. Thereafter, in step 1210, the fuel vapor quantity correction quantity (FPG) is calculated. To be more specific, the purge gas quantity (QP) is multiplied by the fuel vapor concentration (FGprg), and a product thereof is divided by (Engine Speed (NE)×(n/2)), of which a quotient is set as a fuel vapor quantity. Note that n in this formula is the number of cylinders, and the reason why n is divided by 2 is that the air intake in the 4-cycle engine is effected twice during the four revolutions thereof.

When judging in step 1206 that C is not 1", the processing proceeds to step 1211, in which the output fluctuation quantity ΔDLN is obtained by subtracting the output fluctuation DLN0 of the last time from the present output fluctuation DLN. Subsequently, a divided value ΔDLN/N of the output fluctuation quantity ΔDLN of this time is added to the average value avΔDLN of the output fluctuation quantities ΔDLN obtained when executing the routine of the last time, and an added result thereof is set as an output fluctuation average value av ΔDLN of this time (step 1212). Herein, N is an arbitrary value indicating a fuel vapor concentration calculation period.

Thereafter, it is judged whether or not the count value C obtained in step 1205 is larger than N+1 (step 1213). If the count value C is larger than N+1, the count value C is initialized to 0" (step 1214). When judging in step 1213 that the count value C is under N+1, the processing advances directly to step 1210. On the other hand, it is judged subsequent to step 1214 whether or not the fuel vapor concentration FGprg is smaller than the concentration fiducial value FGprg0 (step 1215). If smaller than FGprg0 N2 is substituted into N (step 1216). What is calculated last time as the fuel vapor concentration FGprg is used in step 1215. Note that the concentration fiducial value FGprg0 is an empirically determined value. Further, N2 is a value indicating a detection time.

If it is judged in step 1215 via step 1216 that the fuel vapor concentration FGprg is over the concentration fiducial value FGprg0, the fuel vapor quantity correction quantity (FPG) is calculated in step 1210.

Note that if judged in step 1203 not to be in the process of purging, N1 is substituted into N in step 1217, and the fuel vapor quantity correction quantity is set to 0" in step 1218. N1 may also be a value indicating a detection time as well as being an initial value when starting the purging, and there must be a relationship such as N1<N2.

After the fuel vapor quantity correction quantity (FPG) has been determined in steps 1210 and 1218, the processing proceeds to step 1219, in which the last fuel injection quantity (QALLINJ) is determined. Herein, the last fuel injection quantity (QALLINJ) is determined by subtracting the fuel vapor quantity correction quantity (FPG) from the basic fuel injection quantity (QALL) calculated in step 1202.

It is indicated in step 1206 that the detection of the fuel vapor concentration is executed when starting the purging. Further, as shown in steps 1213, 1214, the count value C is initialized each time this routine is executed (N+1) times, i.e., at the interval of the predetermined time. The fuel vapor concentration is detected in steps 1207 through 1209 on the occasion of executing the program thereafter.

Further, when judging in step 1215 that the fuel vapor concentration is smaller than the concentration fiducial value, i.e., when the concentration is lean, the value N2 larger than N1 is substituted into N, and hence there increases a time till the initialization of C in step 1213 when executing the routine next time. Namely, when the concentration is lean, it is judged in step 1213 that N+1=N2+1. Whereas if the concentration is rich, it is judged in step 1213 that N+1=N1+1<N2+1. Hence, the calculation period of the fuel vapor concentration is shorter when the concentration is rich than when it is lean.

When the purge gas concentration of the canister is rich, as a characteristic of the canister, the output fluctuates more abruptly than when the concentration is lean. Such being the case, it is feasible to make the concentration detection accuracy higher by shortening the calculation period of the fuel vapor concentration than when the concentration is lean.

Eighth Embodiment

An eighth embodiment exemplifies a case where when the purge gas fuel concentration FGprg is estimated from the output fluctuation, the purging is interrupted just when the concentration is under a predetermined value, and the purging resumes after increasing a temperature of the canister, thereby obtaining a rise in a rate of the fuel desorption from the canister.

Figure 27:
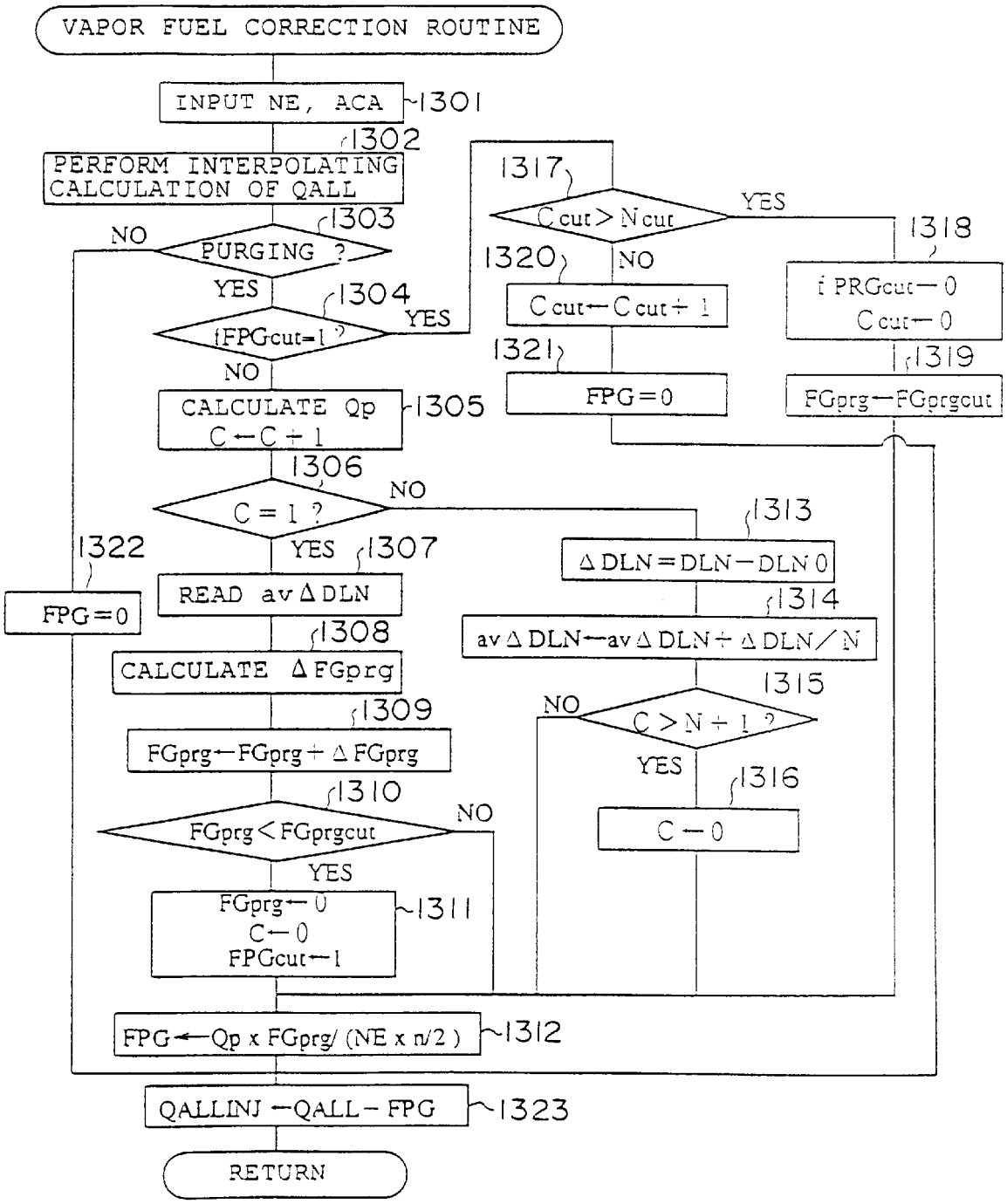
FIG. 27 is a flowchart showing an eighth embodiment.

As shown in FIG. 27, to begin with, the engine speed NE and the accelerator aperture ACA are inputted (step 1301). Subsequently, the basic fuel injection quantity (QALL) is calculated in the interpolating manner in accordance with the input data (step 1302).

It is judged in step 1303 whether in the process of purging or not. If judged to be in the process of purging, it is judged whether or not a purge interruption flag FPGcut is set, i.e., whether or not there is established EPGcut=1 (step 1304). If the flag is not set, the purge gas quantity Qp of the purge gas composed of the air and the fuel vapor is calculated in step 1305. This calculation is done based on the correlation (see FIG. 13) between the throttle aperture TA and the purge gas quantity which are previously stored in the form of the map in the ROM. Further, simultaneously the count value C is incremented by 1".

Next, it is judged in step 1306 whether or not the count value C is 1". If the value C is 1", the average avΔDLN of the output fluctuations at the interval of the predetermined time is read (step 1307). The output fluctuations are detected at all times by the operating state detecting module M7 serving as an output fluctuation detecting module, and the average thereof at the interval of the predetermined time is calculated by another routine at the interval of the predetermined time.

After reading the average of the output fluctuations, the fuel vapor concentration correction quantity ΔFGprg as the fuel vapor concentration correction value is calculated from the map shown in FIG. 17 (step 1308).

When the fuel vapor concentration correction quantity ΔFGprg is determined, this correction quantity is added to the fuel vapor concentration correction quantity FGprg calculated last time, thereby obtaining a new fuel vapor concentration (step 1309). After the fuel vapor concentration has been determined, it is judged whether or not this concentration is smaller than a purge interrupt fiducial concentration (step 1310). If the fuel vapor concentration is smaller than the purge interrupt fiducial concentration, the fuel vapor concentration is set to 0", and the count value C is also set to 0". Besides, the purge interrupt flag FPGcut is set to 1" (step 1311). Herein, the purge interrupt fiducial concentration is a predetermined value (e.g., a concentration 1%) corresponding to a state where the purge gas is substantially conceived as the air, and is previously empirically determined.

Thereafter, the fuel vapor quantity correction quantity (FPG) is calculated in step 1312. To be more specific, the purge gas quantity (QP) is multiplied by the fuel vapor concentration (FGprg), and a product thereof is divided by (Engine Speed (NE)×(n/2)), of which a quotient is set as a fuel vapor quantity. Note that n in this formula is the number of cylinders, and the reason why n is divided by 2 is that the air intake in the 4-cycle engine is effected twice during the four revolutions thereof. If via step 1311, the fuel vapor concentration (FGprg) is 0", and as a result the fuel vapor quantity is also 0".

Whereas if it is judged in step 1310 that the fuel vapor concentration is larger than the purge interrupt fiducial concentration, the processing jumps over step 1311 to step 1312, in which the fuel vapor concentration is calculated.

When judging in step 1306 that C is not 1", the processing proceeds to step 1311, in which the output fluctuation quantity □ ¢DLN is obtained by subtracting th output fluctuation DLN0 of the last time from the present output fluctuation DLN. Subsequently, a divided value ΔDLN/N of the output fluctuation quantity ΔDLN of this time is added to the average value avΔDLN of the output fluctuation quantities ΔDLN obtained when executing the routine of the last time, and an added result thereof is set as an output fluctuation average value avΔDLN of this time (step 1314). Herein, N is an arbitrary value indicating a fuel vapor concentration calculation period.

Thereafter, it is judged whether or not the count value C obtained in step 1305 is larger than N+1 (step 1315). If the count value C is larger than N+1, the count value C is initialized to 0" (step 1316). When judging in step 1315 that the count value C is under N+1, the processing advances directly to step 1312. The fuel vapor concentration FGprg calculated last time is used in step 1312 via steps 1315, 1316 from step 1313.

When judging in step 1304 that the purge interrupt flag FPGcut is set, it is judged whether or not a value of a purge interrupt counter Ccut is larger than a number-of-purge-interruptions Ncut. If the value of the purge interrupt counter Ccut is larger than the number-of-purge-interruptions Ncut, 0" is substituted into the purge interrupt flag FPGcut, and the purge interrupt counter Ccut is initialized (step 1318). Then, the purge interrupt fiducial concentration FGprgcut is used as the fuel vapor concentration FGprg (step 1319). The processing proceeds to step 1312, wherein the fuel vapor quantity correction quantity FPG is calculated.

While on the other hand, when judging in step 1317 that the value of the purge interrupt counter Ccut is under the number-of-purge-interruptions Ncut, the value of the purge interrupt counter Ccut is incremented (step 1320), and the fuel vapor quantity correction quantity FPG is set to 0" (step 1321).

Note that if judged in step 1303 not to be in the process of purging, the fuel vapor quantity correction quantity is set to 0" in step 1322.

After the fuel vapor quantity correction quantity (FPG) has been determined in steps 1312, 1321 and 1322, the processing proceeds to step 1323, in which the last fuel injection quantity (QALLINJ) is determined. Herein, the last fuel injection quantity (QALLINJ) is determined by subtracting the fuel vapor quantity correction quantity (FPG) from the basic fuel injection quantity (QALL) calculated in step 1302.

It is indicated in step 1306 that the detection of the fuel vapor concentration is executed when starting the purging. Further, as shown in steps 1315,1316, the count value C is initialized each time this routine is executed (N+1) times, i.e., at the interval of the predetermined time. The fuel vapor concentration is detected in steps 1307 through 1309 on the occasion of executing the program thereafter.

Furthermore, the purge interrupt judgement is made in steps 1310, 1311, and, when under the predetermined fuel vapor concentration, the purging is interrupted. The following is the reason why interrupted.

Namely, the canister exhibits a high fuel desorbing efficiency when the temperature is high. When the fuel is desorbed from the canister, however, the heat vaporization is absorbed with the result that the temperature lowers. Therefore, the fuel desorbing efficiency declines. Consequently, even when letting the purge gas flow, the fuel can not be desorbed. This being the case, in accordance with eighth embodiment, the purging is temporarily interrupted, the canister temperature is recovered enough to enable the fuel to be desorbed therefrom because of receiving the heat from the ambient portion, whereby the fuel desorbing efficiency can be enhanced.

Ninth Embodiment

A ninth embodiment exemplifies a case where when the purge gas fuel concentration FGprg is estimated from the output fluctuation, and if the concentration is over a predetermined value, a fuel injection angle (a fuel injection timing) and an air quantity are changed so as to be burned uniformly on the whole in the combustion chamber.

Figure 28:
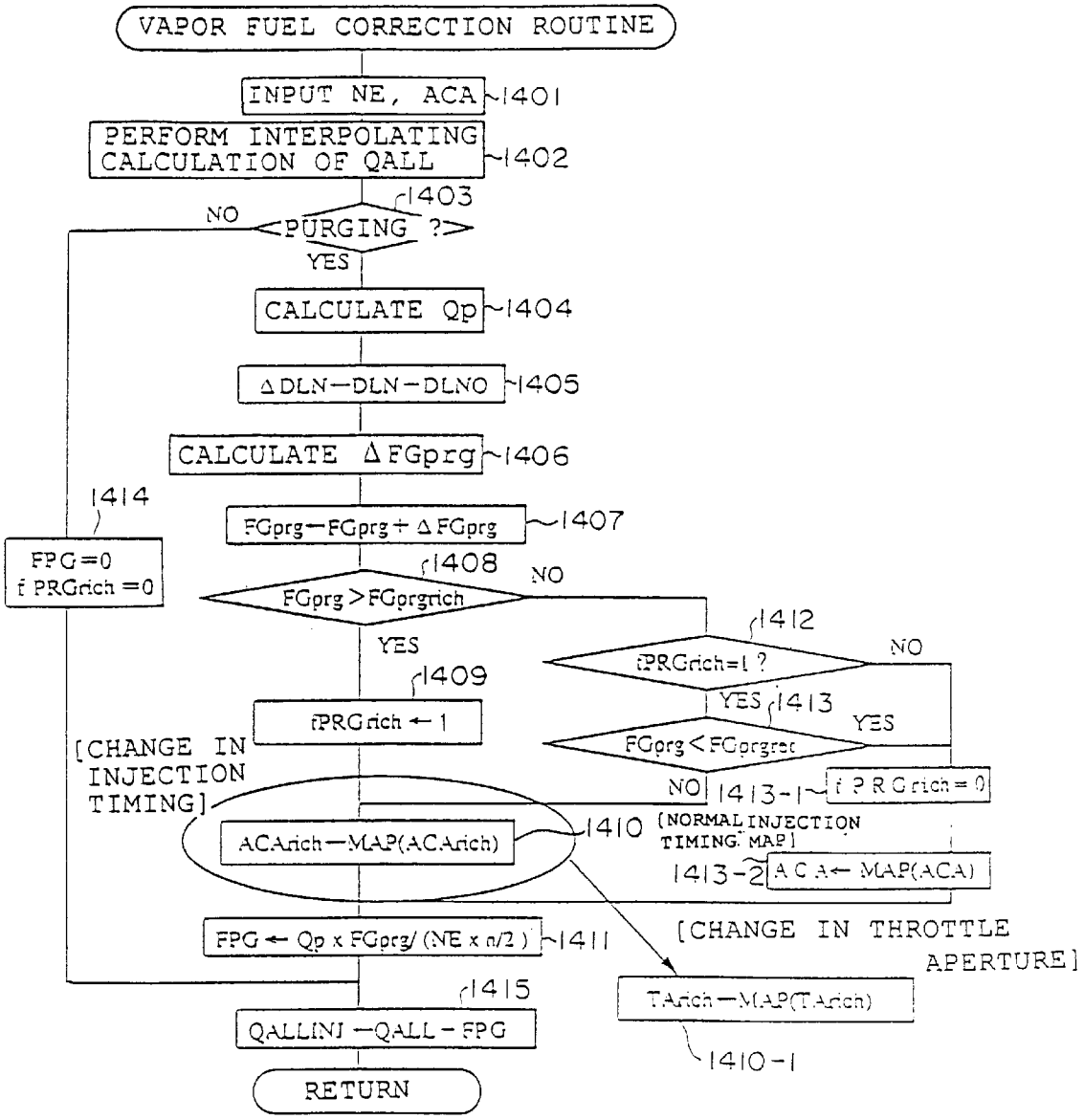
FIG. 28 is a flowchart showing a ninth embodiment.

As shown in FIG. 28, to start with, the engine speed NE and the accelerator aperture ACA are inputted (step 1401). Subsequently, the basic fuel injection quantity (QALL) is calculated in the interpolating manner in accordance with the input data (step 1402).

It is judged in step 1403 whether in the process of purging or not. If judged to be in the process of purging, the purge gas quantity Qp of the purge gas composed of the air and the fuel vapor is calculated in step 1404. This calculation is done based on the correlation (see FIG. 13) between the throttle aperture TA and the purge gas quantity which are previously stored in the form of the map in the ROM. Further, simultaneously the count value C is incremented by 1".

Next, in step 1405, the output fluctuation quantity ΔDLN is obtained by subtracting the output fluctuation DLN0 of the last time from the present output fluctuation DLN.

After calculating the output fluctuation quantity in ste 1405, the fuel vapor concentration correction quantity ΔFGprg as the fuel vapor concentration correction value is calculated from the map shown in FIG. 17 (step 1406).

When the fuel vapor concentration correction quantity ΔFGprg is determined, this correction quantity is added to the fuel vapor concentration correction quantity FGprg calculated last time, thereby obtaining a new fuel vapor concentration (step 1407). When the fuel vapor concentration is determined, it is judged whether or not this concentration is larger than a change fiducial concentration FGprgrich (step 1408). If the fuel vapor concentration FGperg is larger than the change fiducial concentration GFprgrich, 1" is set in a rich concentration judgement flag fPRGrich (step 1409). The change fiducial concentration FGgprgrich is a boundary value (a fiducial value) for establishing the combustion in the normal state from a relationship between the detected concentration of the fuel vapor and the present injection timing, and is previously empirically determined. Namely, the fuel vapor concentration becomes rich during the stratified charge combustion, and, if it is judged that the stratified charge combustion is not established, the injection timing is advanced toward the intake stroke from the compression stroke.

Subsequently, a fuel injection timing ACArich when the purge is rich is read from a map MAP (ACArich) shown in FIG. 29 (step 1410). In this map, the fuel injection timing when the purge is rich is prescribed in the relation to the engine speed.

Note that instead of step 1410, a throttle aperture (TArich) is read from the throttle aperture map (TArich) when the purge is rich, and may be changed (step 1410-1).

Thereafter, the fuel vapor quantity correction quantity (FPG) is calculated in step 1411. To be more specific, the purge gas quantity (QP) is multiplied by the fuel vapor concentration (FGprg), and a product thereof is divided by (Engine Speed (NE)×(n/2)), of which a quotient is set as a fuel vapor quantity. Note that n in this formula is the number of cylinders, and the reason why n is divided by 2 is that the air intake in the 4-cycle engine is effected twice during the four revolutions thereof.

When judging in step 1408 that the fuel vapor concentration is under the change fiducial concentration FGprgrich, it is judged in step 1412 whether or not the rich concentration judgement flag fPRGrich is set to 1". If 1" is set, it is judged in step 1413 whether or not the fuel vapor concentration FGprg is smaller than a return concentration FGprgret. If the fuel vapor concentration FGprg is smaller than the return concentration FGprgret, the rich concentration judgement flag fPRGrich is set to 0" (step 1413-1), and the injection timing is read from an injection timing map (step 1413-2). Then, the processing proceeds to step 1411. When judging in step 1413 that the fuel vapor concentration FGprg is larger than the return concentration FGprgret, the processing advances to step 1410. Note that the return concentration FGprgret is a value smaller than the change fiducial concentration FGprgrich and corresponds to a concentration enough to return the injection timing to its initial timing when the fuel vapor concentration becomes lean. This return concentration FGprgret is previously empirically determined. That is, when the fuel vapor concentration becomes lean enough to establish the stratified charge combustion, the injection timing is delayed toward the compression stroke from the intake stroke.

Further, when judging in step 1412 that the rich concentration judgement flag fPRGrich is not set to 1", the processing proceeds to step 1411.

Note that if judged in step 1403 not to be in the process of purging, in step 1414, the fuel vapor quantity correction quantity is set to 0", and the rich concentration judgement flag fPRGrich is set to 0".

After the fuel vapor quantity correction quantity (FPG) has been determined in steps 1411 and 1414, the processing proceeds to step 1415, in which the last fuel injection quantity (QALLINJ) is determined. Herein, the last fuel injection quantity (QALLINJ) is determined by subtracting the fuel vapor quantity correction quantity (FPG) from the basic fuel injection quantity (QALL) calculated in step 1402. The fuel is injected with this fuel injection quantity at the fuel injection timing in accordance with a specially set fuel injection program.

As shown in step 1408, when the fuel vapor concentration FGprg calculated based on the output fluctuation is larger than a predetermined change fiducial concentration, the fuel injection timing or the throttle aperture is changed so that the combustion takes place on the whole within the combustion chamber, i.e., the uniform combustion takes place. It is therefore feasible to prevent a deterioration of exhaust emissions and ensure the purge quantity of the canister.

Tenth Embodiment

A tenth embodiment exemplifies a case where the purge gas fuel concentration FGprg is, when estimated from the output fluctuation, detected at an interval of a predetermined time, and in this instance the EGR (Exhaust Gas Recirculation) is cut when detecting the concentration.

Figure 29:
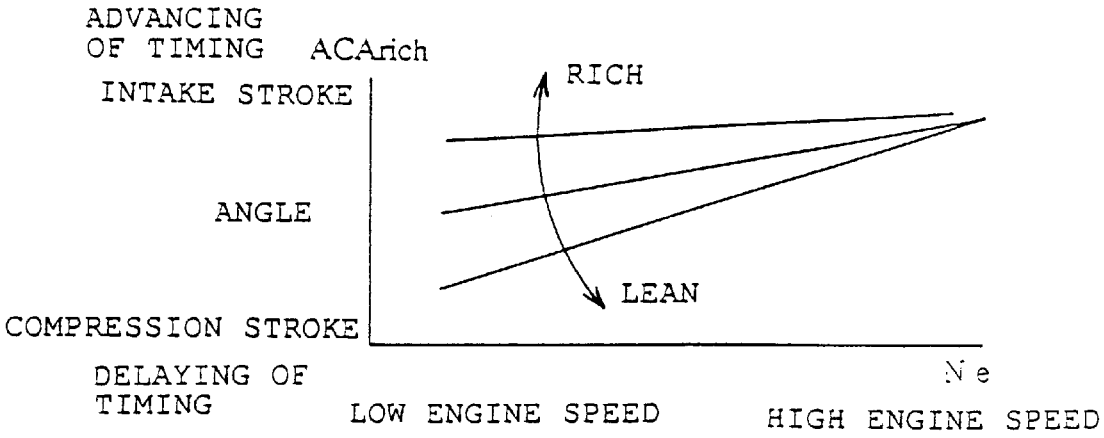
FIG. 29 is a flowchart showing a seventh embodiment.

As shown in FIG. 29, to begin with, the engine speed NE and the accelerator aperture ACA are inputted (step 1501). Subsequently, the basic fuel injection quantity (QALL) is calculated in the interpolating manner in accordance with the input data (step 1502).

It is judged in step 1503 whether in the process of purging or not. If judged to be in the process of purging, the purge gas quantity Qp of the purge gas composed of the air and the fuel vapor is calculated (step 1504). This calculation is done based on the correlation (see FIG. 13) between the throttle aperture TA and the purge gas quantity which are previously stored in the form of the map in the ROM.

Figure 30:
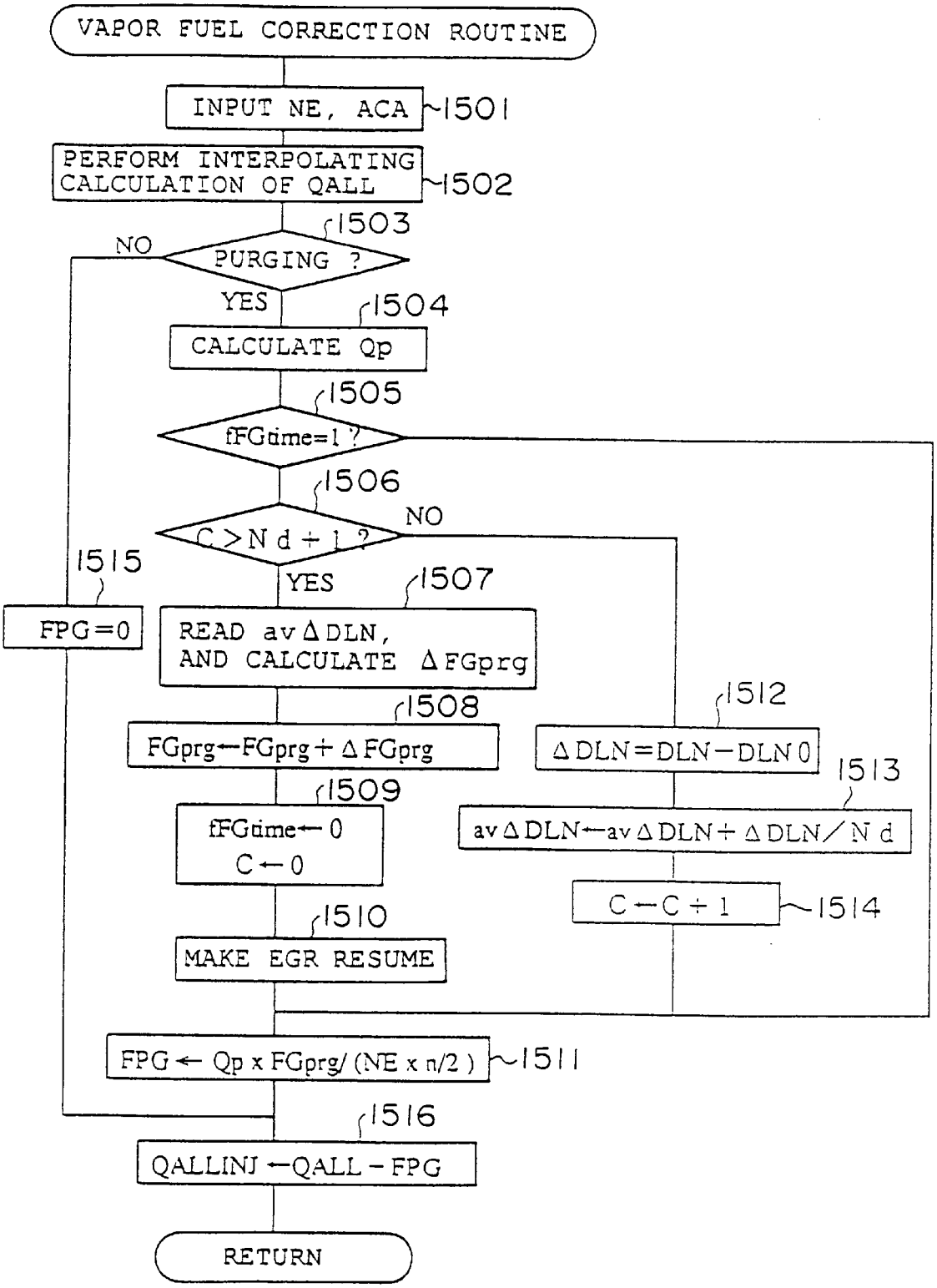
FIG. 30 is a flowchart showing a fuel vapor correction routine.
Figure 31:
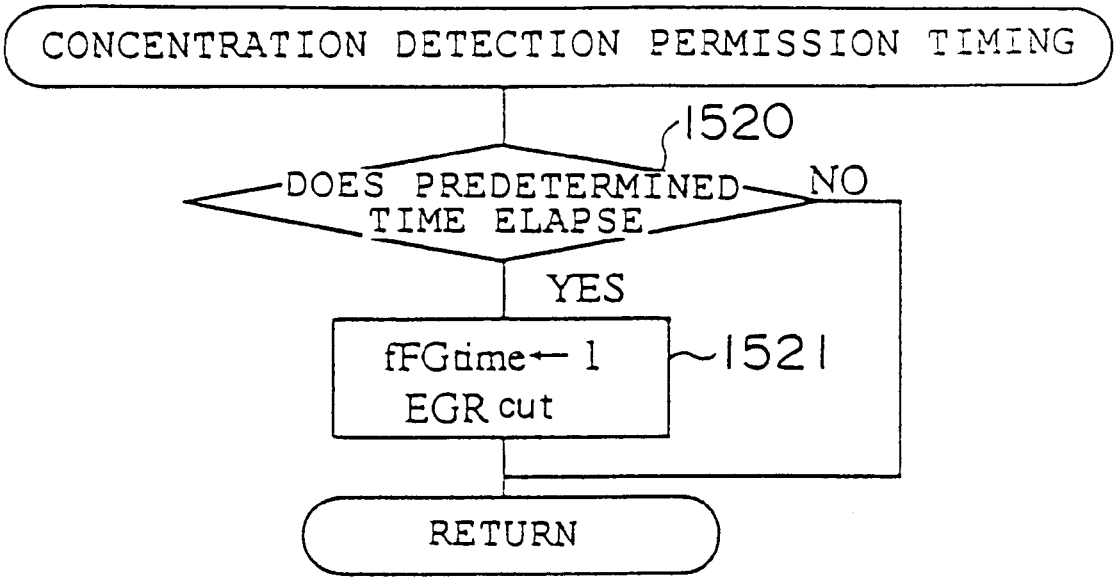
FIG. 31 is a flowchart showing a concentration detection permission timing.

Next, it is judged whether or not a concentration detection permission flag fFGtime is set to 1" (step 1505). With respect to a permission timing of the concentration detection permission flag fFGtime, another routine shown in FIG. 30 can be executed at an interval of a predetermined time. To begin with, it is judged in step 1520 whether or not the predetermined time elapses. If the predetermined time does not elapse, there is a wait for till the predetermined time elapses. If the predetermined time elapses, the concentration detection permission flag fFGtime is set to 1" in step 1521, and the EGR-cut is executed.

When judging in step 1505 that the concentration detection permission flag fFGtime is set to 1", the processing proceeds to step 1506, in which it is judged whether or not the count value C is larger than Nd+1. Herein, Nd is a value indicating a concentration detection time. If the count value C is larger than Nd+1, an average avΔDLN of the output fluctuations at the interval of the predetermined time is read (step 1507). The output fluctuations are detected at all times by the operating state detecting module M7 serving as an output fluctuation detecting module, and the average thereof at the interval of the predetermined time is calculated by another routine at the interval of the predetermined time. Further, at the same time, the fuel vapor concentration correction quantity ΔFGprg as the fuel vapor concentration correction value is calculated from the map shown in FIG. 17.

When the fuel vapor concentration correction quantity ΔFGprg is determined, this correction quantity is added to the fuel vapor concentration correction quantity FGprg calculated last time, thereby obtaining a new fuel vapor concentration (step 1508). Subsequently, the concentration detection permission flag fFGtime is set to 0", the count value C is initialized to 0" (step 1509), and the EGR resumes (step 1510).

Thereafter, the fuel vapor quantity correction quantity (FPG) is calculated in step 1511. To be more specific, the purge gas quantity (QP) is multiplied by the fuel vapor concentration (FGprg), and a product thereof is divided by (Engine Speed (NE)×(n/2)), of which a quotient is set as a fuel vapor quantity. Note that n in this formula is the number of cylinders, and the reason why n is divided by 2 is that the air intake in the 4-cycle engine is effected twice during the four revolutions thereof.

When judging in step 1505 that the concentration detection permission flag fFGtime is not set to 1", the processing diverts directly to step 1511.

Further, when judging in step 1506 that the count value C is under Nd+1, the output fluctuation quantity ΔDLN is obtained by subtracting the output fluctuation DLN0 of the last time from the present output fluctuation DLN. Subsequently, a divided value ΔDLN/Nd of the output fluctuation quantity ΔDLN of this time is added to the average value avΔDLN of the output fluctuation quantities ΔDLN obtained when executing the routine of the last time, and an added result thereof is set as an output fluctuation average value avΔDLN of this time (step 1513). Thereafter, the count value C is incremented by 1" in step 1514, and the processing advances to step 1511.

When diverting directly to step 1511 from step 1505, and when proceeding to step 1511 via steps 1512 and 1514, the fuel vapor concentration FGprg calculated last time is used in step 1511.

Note that if judged in step 1503 not to be in the process of purging, in step 1515, the fuel vapor quantity correction quantity is set to 0".

After the fuel vapor quantity correction quantity (FPG) has been determined in steps 1511 and 1515, the processing proceeds to step 1516, in which the last fuel injection quantity (QALLINJ) is determined. Herein, the last fuel injection quantity (QALLINJ) is determined by subtracting the fuel vapor quantity correction quantity (FPG) from the basic fuel injection quantity (QALL) calculated in step 1502.

As discussed above, the fuel vapor concentration is calculated from steps 1506, 1509 and 1514 after the predetermined time has elapsed since the purging was started. Then, when detecting the concentration, with the execution in step 1521, the EGR is cut. It is therefore possible to eliminate the fluctuations in the combustion due to the EGR and to enhance the accuracy of detecting the concentration.

Note that the EGR in the tenth embodiment can be applied, in addition to the external EGR through the EGR passageway 52 shown in FIG. 2, to an internal EGR based on a variable valve timing mechanism capable of making variable a lift quantity and opening/closing timings of an intake valve and an exhaust valve of the internal combustion engine.

As described in greater details, according to the present invention, the fuel vapor concentration in the lean-burn region can be easily estimated, and the purge control and the control of the fuel injection state can be preferably conducted based on the estimated concentration.

Hence, it is feasible to calculate the fuel vapor concentration in the region where the actual air/fuel ratio sensor is unable to detect the concentration. Then, the purge quantity or the fuel injection state is properly changed in accordance with the detected fuel vapor concentration, thereby making it feasible to restrain the deteriorations of both of the drivability and the exhaust emissions in the lean-burn internal combustion engine.

The many features and advantages of the invention are apparent from the detailed specification and, thus, it is intended by the appended claims to cover all such features and advantages of the invention which fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. In a lean-burn internal combustion engine comprising:

a purge passageway for purging, into an intake system of said internal combustion engine, a fuel vapor generated from fuel storing module for storing the fuel of said internal combustion engine; and purge control means for controlling a quantity of the fuel vapor introduced into said intake system from said purge passageway in accordance with an operating state of said internal combustion engine, an apparatus for detecting a concentration of a fuel vapor in a lean-burn internal combustion engine, comprising:

output fluctuation detecting means for detecting an output fluctuation when the fuel vapor is purged; and concentration detecting means for calculating a concentration of the fuel vapor in accordance with a magnitude of the output fluctuation detected by said output fluctuation detecting means.

2. An apparatus for controlling a supply of a fuel vapor in a lean-burn internal combustion engine according to claim 1, wherein said concentration detecting means detects the fuel vapor concentration in an operating state where the combustion in the internal combustion engine is stabilized.

3. An apparatus for controlling a supply of a fuel vapor in a lean-burn internal combustion engine according to claim 1, wherein said concentration detecting means detects the concentration from the output fluctuation when the fuel vapor is purged during a lean-burn operation.

4. An apparatus for controlling a supply of a fuel vapor in a lean-burn internal combustion engine according to claim 1, wherein when detecting an operating condition under which the concentration of the fuel vapor to be purged changes on the occasion of the detection of the fuel vapor concentration by said concentration detecting means, a concentration detection period is changed.

5. An apparatus for controlling a supply of a fuel vapor in a lean-burn internal combustion engine according to claim 1, wherein said concentration detecting means executes and stops the purge by said purge control means in accordance with a magnitude of the detected concentration.

6. An apparatus for controlling a supply of a fuel vapor in a lean-burn internal combustion engine according to claim 1, wherein said lean-burn internal combustion engine includes exhaust gas recirculating means for recirculating the exhaust gas to said combustion chamber, and stopping the recirculation of the exhaust gas when said concentration detecting means detects the concentration.

7. An apparatus for controlling a supply of a fuel vapor in a lean-burn internal combustion engine, comprising:

a purge passageway for purging, into an intake system of said internal combustion engine, a fuel vapor generated from fuel storing means for storing the fuel of said internal combustion engine;

purge control means for controlling a quantity of the fuel vapor introduced into said intake system from said purge passageway in accordance with an operating state of said internal combustion engine;

output fluctuation detecting means for detecting an output fluctuation when the fuel vapor is purged;

concentration detecting means for calculating a concentration of the fuel vapor in accordance with a magnitude of the output fluctuation detected by said output fluctuation detecting means; and flow rate changing means for changing a purge quantity on the basis of the fuel vapor concentration calculated by said concentration detecting means.

8. An apparatus for controlling a supply of fuel vapor in a lean-burn internal combustion engine according to claim 7, wherein said concentration detecting means detects the fuel vapor concentration in an operating state where the combustion in the internal combustion engine is stabilized.

9. An apparatus for controlling a supply of a fuel vapor in a lean-burn internal combustion engine according to claim 7, wherein said concentration detecting means detects the concentration from the output fluctuation when the fuel vapor is purged during a lean-burn operation.

10. An apparatus for controlling a supply of a fuel vapor in a lean-burn internal combustion engine according to claim 7, wherein when detecting an operation condition under which the concentration of the fuel vapor to be purged changes on the occasion of the detection of the fuel vapor concentration by said concentration detecting means, a concentration detection period is changed.

11. An apparatus for controlling a supply of a fuel vapor in a lean-burn internal combustion engine according to claim 7, wherein said concentration detecting means executes and stops the purge by said purge control means in accordance with a magnitude of the detected concentration.

12. An apparatus for controlling a supply of a fuel vapor in a lean-burn internal combustion engine according to claim 7, wherein said lean-burn internal combustion engine includes exhaust gas recirculating means for recirculating the exhaust gas to said combustion chamber, and stopping the recirculation of the exhaust gas when said concentration detecting means detects the concentration.

13. An apparatus for controlling a supply of a fuel vapor in a lean-burn internal combustion engine, comprising:

a purge passageway for purging, into an intake system of said internal combustion engine, a fuel vapor generated from fuel storing means for storing the fuel of said internal combustion engine;

purge control means for controlling a quantity of the fuel vapor introduced into said intake system from said purge passageway in accordance with an operating state of said internal combustion engine;

output fluctuation detecting means for detecting an output fluctuation when the fuel vapor is purged;

concentration detecting means for calculating a concentration of the fuel vapor in accordance with a magnitude of the output fluctuation detected by said output fluctuation detecting means; and injection state changing means for changing a state of the fuel injection in accordance with the fuel vapor concentration.

14. An apparatus for controlling a supply of a fuel vapor in a lean-burn internal combustion engine according to claim 13, wherein the state of the fuel injection is a fuel injection timing, and the injection timing is changed corresponding to the detected concentration of the fuel vapor.

15. An apparatus for controlling a supply of fuel vapor in a lean-burn internal combustion engine according to claim 13, wherein said concentration detecting means detects the fuel vapor concentration in an operating state where the combustion in the internal combustion engine is stabilized.

16. An apparatus for controlling a supply of a fuel vapor in a lean-burn internal combustion engine according to claim 13, wherein said concentration detecting means detects the concentration from the output fluctuation when the fuel vapor is purged during a lean-burn operation.

17. An apparatus for controlling a supply of a fuel vapor in a lean-burn internal combustion engine according to claim 13, wherein when detecting an operation condition under which the concentration of the fuel vapor to be purged changes on the occasion of the detection of the fuel vapor concentration by said concentration detecting means, a concentration detection period is changed.

18. An apparatus for controlling a supply of a fuel vapor in a lean-burn internal combustion engine according to claim 13, wherein said concentration detecting means executes and stops the purge by said purge control means in accordance with a magnitude of the detected concentration.

19. An apparatus for controlling a supply of a fuel vapor in a lean-burn internal combustion engine according to claim 13, wherein said lean-burn internal combustion engine includes exhaust gas recirculating means for recirculating the exhaust gas to said combustion chamber, and stopping the recirculation of the exhaust gas when said concentration detecting means detects the concentration.

* * * * *